US010208475B2

(12) United States Patent
Heather et al.

(10) Patent No.: US 10,208,475 B2
(45) Date of Patent: Feb. 19, 2019

(54) BUILDING MODULES

(75) Inventors: David Heather, High Wycombe (GB); Colin Ewart Harding, Bournemouth (GB); Rufus Harold Harding, Ebbesbourne Wake (GB); Roderick MacDonald, London (GB); Richard Clive Ogden, Stoke Poges (GB)

(73) Assignee: Verbus International Limited, London (GB)

( * ) Notice: Subject to any disclaimer, the term of this patent is extended or adjusted under 35 U.S.C. 154(b) by 1465 days.

(21) Appl. No.: 10/575,925

(22) PCT Filed: Oct. 15, 2004

(86) PCT No.: PCT/GB2004/004400
§ 371 (c)(1),
(2), (4) Date: May 1, 2007

(87) PCT Pub. No.: WO2005/038155
PCT Pub. Date: Apr. 28, 2005

(65) Prior Publication Data

US 2007/0271857 A1 Nov. 29, 2007

(30) Foreign Application Priority Data

Oct. 17, 2003 (GB) ..... 0324363.1

(51) Int. Cl.
*E04B 1/348* (2006.01)
*B65D 88/00* (2006.01)
(Continued)

(52) U.S. Cl.
CPC ..... *E04B 1/3483* (2013.01); *B65D 88/005* (2013.01); *B65D 88/022* (2013.01);
(Continued)

(58) Field of Classification Search
CPC ..... B65D 88/005; B65D 88/022; B65D 90/0006; B65D 90/0026; B65D 88/027;
(Continued)

(56) References Cited

U.S. PATENT DOCUMENTS 3,722,714 A * 3/1973 Morris et al. ..... 410/85
3,752,511 A * 8/1973 Racy ..... 24/287
(Continued)

FOREIGN PATENT DOCUMENTS

DE 93 12 966 1/1994
EP 0 034 185 8/1981
(Continued)

*Primary Examiner* — William V Gilbert
(74) *Attorney, Agent, or Firm* — Haug Partners LLP

(57) ABSTRACT

A building module has an exterior shape generally of a cuboid having side, end, top and bottom faces, and fabricated from metal, the module being hollow and defining a space of a size suitable for occupation by a person. The module includes fastening elements (21, 69) to allow the module to be fastened to another adjacent module and to allow for engagement by standard load handling equipment for handling freight containers. The module has an overall exterior width greater than 2700 mm and includes a first set of fastening elements (21, 69A, 69B, 69C, 69D) in the region of a first end of the top of the module and a second end of the top of the module. The fastening elements of each set include two fastening elements (e.g. 21 and 69C) spaced apart from one another at a center-to-center spacing (D) of about (2260) mm.

48 Claims, 28 Drawing Sheets

Figure 1:
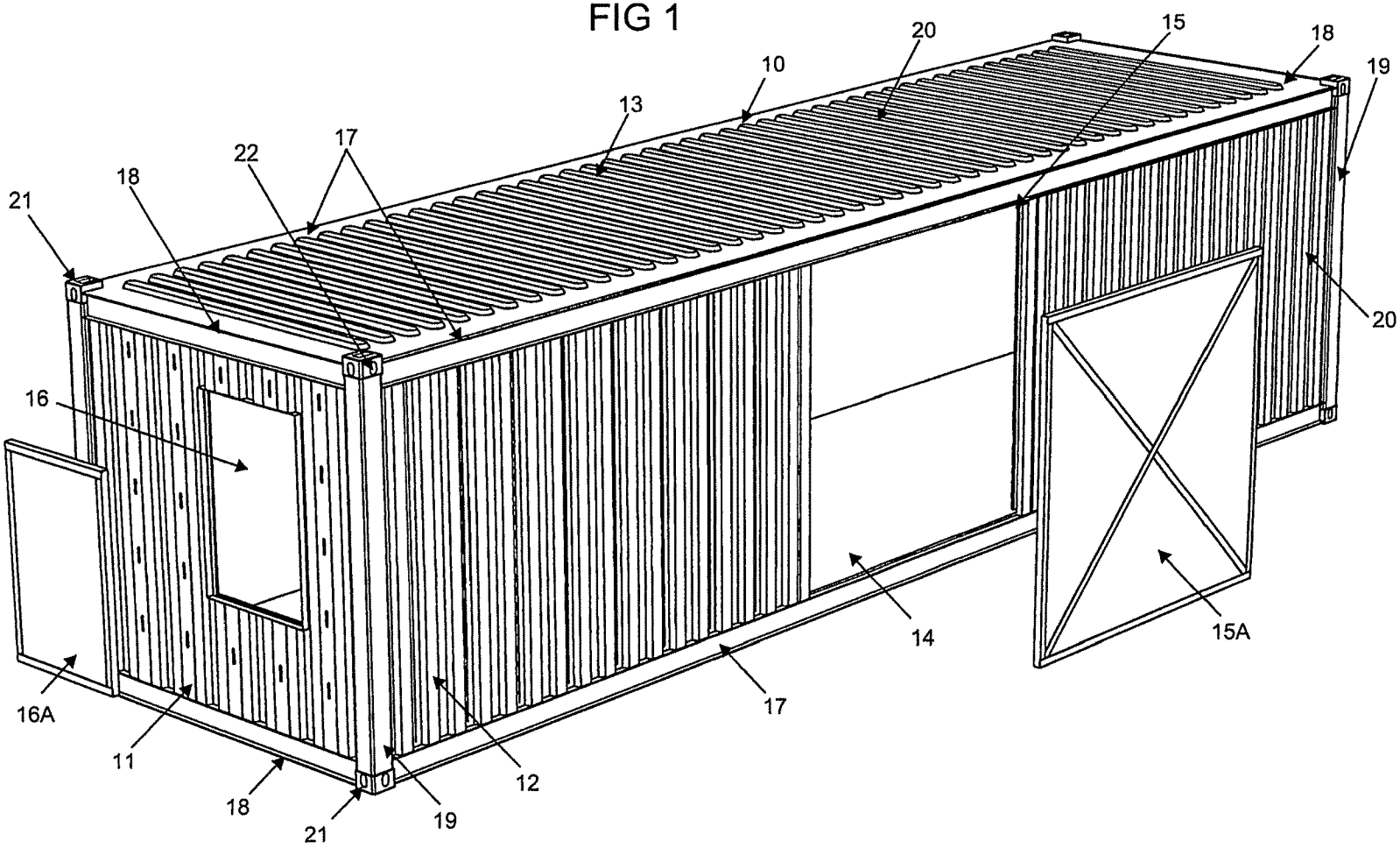

(51) Int. Cl.
*B65D 88/02* (2006.01)
*B65D 90/00* (2006.01)

(52) U.S. Cl.
CPC ..... *B65D 90/0006* (2013.01); *B65D 90/0026* (2013.01); *E04B 2001/34892* (2013.01)

(58) Field of Classification Search
CPC ..... B65D 88/121; E04B 1/3483; E04B 2001/34892
USPC ..... 52/79.1, 79.7, 79.9
See application file for complete search history.

(56) References Cited

U.S. PATENT DOCUMENTS

| | | | | | |
|---|---|---|---|---|---|
| 4,358,145 | A | * | 11/1982 | Svensson | 294/68.3 |
| 4,599,829 | A | * | 7/1986 | DiMartino, Sr. | 52/79.7 |
| 5,072,845 | A | * | 12/1991 | Grogan | 220/1.5 |
| 5,449,081 | A | * | 9/1995 | Sjostedt et al. | 220/1.5 |
| 5,706,614 | A | * | 1/1998 | Wiley et al. | 52/79.1 |
| 6,027,291 | A | * | 2/2000 | Sain et al. | 410/35 |
| 6,155,747 | A | * | 12/2000 | Payne et al. | 405/129.55 |
| 6,381,977 | B1 | * | 5/2002 | Austin, Jr. | 62/259.1 |
| 6,422,795 | B2 | * | 7/2002 | Holt et al. | 410/115 |
| 6,877,939 | B2 | * | 4/2005 | Tomkins et al. | 410/46 |

FOREIGN PATENT DOCUMENTS

| | | | | |
|---|---|---|---|---|
| EP | 0 175 446 | A | | 3/1986 |
| EP | 175446 | A1 | * | 3/1986 |

* cited by examiner

BUILDING MODULES

This application is a 371 of PCT/GB2004/004400 filed on Oct. 15, 2004, published on Apr. 28, 2005 under publication number WO 2005/038155 A1 which claims priority benefits from Great Britain Patent Application Number 0324263.1 filed Oct. 17, 2003.

This invention relates to a building module, to buildings made from such modules and to the construction of buildings using such modules.

There have been many prior proposals for constructing buildings from prefabricated units. In some proposals, panels are prefabricated and transported to a site for assembly into a building. The transport of the panels is reasonably straightforward but the assembly on site involves a considerable amount of labour. In other proposals, an entire building is prefabricated and transported, often with some difficulty. Another option is to make a building from several prefabricated three-dimensional modules and assemble the modules on site, but in that case both transport and assembly tend to be time-consuming and expensive. In an attempt to alleviate that problem it has been proposed to use a conventional freight container as a building module. For example, U.S. Pat. No. 4,599,829 shows a building system formed of freight containers. The containers are each of the standard dimensions of a freight container and have corner castings at each of their corners. Those corner castings are provided at the standard spacings (a centre-to-centre spacing of about 2259 mm) so that the container can be handled in the same way as a conventional freight container.

It is an object of the invention to provide an improved form of building module.

It is a further object of the invention to provide an improved form of building made from such modules.

It is a still further object of the invention to provide an improved method of constructing a building using such modules.

According to a first particular aspect of the invention there is provided a building module having an exterior shape generally of a cuboid having side, end, top and bottom faces, and fabricated from metal, the module being hollow and defining a space of a size suitable for occupation by a person, the module including fastening elements to allow the module to be fastened to another adjacent module to allow for engagement by standard load handling equipment for handling freight containers, wherein the module has an overall exterior width greater than 2700 mm and includes a first set of fastening elements in the region of a first end of the top of the module and a second set of fastening elements in the region of a second end of the top of the module, the fastening elements of each set including two fastening elements spaced apart from one another at a centre-to-centre spacing of about 2260 mm.

Thus the invention provides a module which can be of a size that enables it to be transported but which is able to be fastened to other modules on site to form a larger building in a quick and simple manner. Furthermore by providing fastening elements at a centre-to-centre spacing of about 2260 mm, handling and transport of the module is greatly facilitated since the module can be handled and transported by the same equipment as handles and transports standard freight containers.

Preferably the two fastening elements are symmetrically positioned on opposite sides of a central vertical plane of the module. In that case, they will both be inboard of the sides of the module and it is generally preferred that the set of fastening elements further include third and fourth elements at the opposite side edges of the top of the module. It is also preferred that each of the first and second sets of fastening elements comprises more than two fastening elements at locations spaced across the top of the module each fastening element being spaced from another fastening element at a centre-to-centre spacing of about 2260 mm.

The first and second sets of fastening elements will usually be provided at the opposite ends of the module but that will not necessarily be the case and they may be provided inboard of the ends so as to be spaced apart from one another longitudinally by a standard distance. Thus reference is also made to the sets of fastening elements being in the regions of the ends of the module.

In addition to providing first and second sets of fastening elements in the regions of the ends of the top of the module, third and fourth sets of fastening elements are preferably provided in the regions of the ends of the bottom of the module. The third and fourth sets of fastening elements may be arranged in the same way as described above in respect of the first and second sets of fastening elements.

Preferably there are respective elongate members in the region of each of the eight edges of the cuboid and a plurality of metal panels secured to at least some of the elongate members. The elongate members are preferably of an open or hollow section, for example of hot or cold rolled or folded section, prefabricated section or rectangular hollow section. The elongate members and panels preferably together define a monocoque structure. The elongate members and panels are preferably made of steel. Such a construction enables a module as large as can readily be transported by road to be fabricated with sufficient strength that it is self supporting. Furthermore, when in use the module is fastened to other modules that can enhance their strengths so that a structurally strong building can be formed by fastening the modules together. Such a structure can have sufficient strength not only to support itself even as a multi-storey structure (consisting for example of more than 10 or 20 storeys) but also to support other structural elements such as bridging elements or cantilevered elements without additional structural support.

In most cases, it will be preferred that there are metal panels secured on all of the side and end faces of the cuboid, and preferably also on the top and bottom faces of the cuboid. At least some of the metal panels may be corrugated. Such corrugations add to the strength and stiffness of the panel. One or more of the metal panels may, whether or not they are corrugated, be of composite construction and may for example include insulating material and/or an inner lining.

Since the module is to form part of a building, it is preferable that it is fabricated with appropriate openings formed therein. The openings may be covered over for the purpose of transporting modules from a factory where they are fabricated to a site where they are to be used in a building; such temporarily closed openings in the module are hereby defined as "open" for the purpose of this specification. For example, one side face or each side face of the module may be partly closed by a panel and be partly open; similarly, one end face or each end face of the module may be partly closed by a panel and be partly open. The partly open face, or one of the partly open faces, may extend from a region at the bottom of the face to a region at the top of the face; that may provide an access route, for example a doorway, into the module for a person; of course, the doorway need not extend to the very top or the very bottom of the face. The partly open face, or one of the partly open faces, may extend upwardly from a region partway up the face. That may for example provide a window opening. One or more openings may also be provided in the top or bottom faces of the module, for example to accommodate a staircase, lift or services within the module.

The module may be fabricated as a completely empty shell and may remain in that state until after assembly into a building. More commonly, however, it will be preferable to carry out a degree of fitting out either in the factory or on site but prior to assembly into a building. For example, insulation may be added to walls, floors and ceilings, a plywood lining may be provided over the insulation, doors, windows and balconies may be added. Further examples may be electrical, power and lighting cabling systems, heating and plumbing systems, telecommunications systems and other media communications systems. A cladding may also be added to one or more faces of the module. That cladding may be brickwork or some other cladding such as wood panelling, metal sheet cladding. The cladding may be tile hung or in the form of a curtain wall. The cladding may provide a glass façade. Ties or other systems for holding the cladding in place may be provided. The ties may be retained in slots in a panel forming a face of the module; alternatively cladding fixings may be fixed to castings or plates of a frame of the module. A pod containing selected fittings may be installed in the module. For example there may be a kitchen pod containing kitchen fittings or a bathroom pod containing bathroom fittings. Such a pod may occupy a minor part only of the interior volume of the module.

The ability of the module to be fastened to adjacent modules represents a key feature of the invention. Preferably the fastening elements of the module are suitable for fastening the module to an adjacent module placed alongside and/or to an adjacent module placed end-to-end and/or to an adjacent module placed above or below. Thus modules may be fastened together in arrays of one, two or three dimensions. Most commonly the modules are fastened together in a two- or three-dimensional array with a plurality of storeys, each storey comprising a plurality of modules placed alongside one another.

At least some of the fastening elements are preferably provided in the region of the eight corners of the module. As will be clear from the description below, those fastening elements may be the only fastening elements, but there may also be other fastening elements, for example partway along the top and/or bottom side edges of the module. Such a fastening element may transfer a building load to a foundation and/or provide a connection to an adjacent module.

In accordance with an especially preferred feature of the invention, at least some of the fastening elements are defined by hollow blocks with openings through which connector elements can be inserted. The fastening elements are preferably provided with openings in their top, side and end faces or bottom, side and end faces. The fastening elements are preferably welded to the elongate members. The fastening elements may be in the same general form as corner castings of freight containers and may be in accordance with ISO/TC-104-1161. Some or all of the fastening elements may, however, be of a design which differs from ISO/TC-104-1161 in order to meet the special requirements of a building module of the present invention. For example longer fastening elements may be used in some cases and where fastening elements are provided away from the corners of the module they may have a top or bottom opening and only one further aperture. Furthermore openings in the fastening elements may vary from the standard and, for example, a fastening element on the top of the module may have an opening in its end face of the kind provided in a standard container for the front face of a fastening element at the bottom of the container. That facilitates handling and transport of the module between a factory where it is fabricated and its final destination. By using the same fastening elements for transporting and handling the module as are used for securing one module to another an especially advantageous, economical and time saving system is provided.

The connector elements and hollow blocks are preferably arranged such that after a connector element has been inserted into an opening in a hollow block it can be fastened in the opening. Thus the connector element preferably not only locates the module relative to the connector element but also fastens it to the connector element. Various fastening arrangements, including manual and automatic arrangements, may be employed, depending upon the particular circumstances. The connector elements and hollow blocks may be arranged such that after a connector element has been inserted into an opening in a hollow block it can be fastened in the opening by a fastener entering the hollow block through another opening and engaging the connector element. In that manner a very strong and reliable fastening of the connector element to the block can be obtained. The connector elements may be fastened in the hollow blocks by fasteners screw threadedly engaging the connector elements in the hollow blocks.

To connect one module to another which may be immediately above or below it, or alongside it, the connector elements preferably include a connector element that has a first part for insertion into an opening in one fastening element of one module and a second part for insertion into an opening in another fastening element of another module. In other cases it is desirable to connect four modules together, for example to connect two modules that are alongside one another to two further modules immediately above them to form what may be regarded as a two-dimensional array of modules. For that purpose the connector elements preferably include a connector element that has a first part for insertion into an opening in one fastening element of one module, a second part for insertion into an opening in another fastening element of another module, a third part for insertion into an opening in yet another fastening element of yet another module and a fourth part for insertion into an opening in a still further fastening element of a still further module. In further cases it is desirable to connect further modules in end-to-end relationship with some of the modules to form what may be regarded as a three-dimensional array of modules. For that purpose the connector elements preferably include a connector element having the first to fourth parts referred to above, but also fifth, sixth, seventh and eighth parts for insertion into openings in fastening elements of other modules.

Gaskets are preferably located between a connector element and a hollow block into which the connector element is inserted. Such a gasket can accommodate expansion or contraction of modules, relieve stresses and isolate acoustic vibration.

Where reference is made herein to a corner casting, it should be understood that the term "casting" is employed because that is the standard terminology. Whilst such elements are usually formed by casting, it is not an essential feature of the invention that they are formed by casting. They may for example be fabricated from sheet steel. Furthermore where reference is made to a corner casting or a block it should be understood that, whilst such an element will usually be formed separately and subsequently fixed to the rest of the module for example by welding, it is within the scope of the invention for the corner casting or block to be formed as an integral part of the rest of the structure of the module.

Standard load handling apparatus is designed to engage corner castings having a centre-to-centre spacing of about 2260 mm (the precise spacing is usually intended to be 2259 mm in accordance with the Standards and is therefore referred to here as "about 2260 mm"). In accordance with another aspect of the invention the overall exterior width of the module may be in the range of 2350 mm to 2500 mm, allowing for corner castings at the corners of the module to have a centre-to-centre spacing of about 2260 mm. In most applications, however, it will be desirable for the module to have a greater overall width. In that case it may be desirable to provide one or more additional fastening elements along each top and bottom end edge of the module; a single additional fastening element may be adequate and may be spaced at a centre-to-centre spacing of about 2260 mm from a fastening element at a corner of the module. That fastening element may be off centre or may be equispaced from corners at opposite sides of the module. Alternatively and as described above, a pair of additional fastening elements may be provided symmetrically on either side of a central plane of the module along a top end edge of the module at a centre-to-centre spacing of about 2260 mm. It is also desirable to provide a pair of additional fastening elements symmetrically on either side of a central plane of the module along a bottom end edge of the module at a centre-to-centre spacing of about 2260 mm. The additional fastening elements can then be used, for example, to secure a module on a road trailer/chassis or a transport chassis provided at a handling terminal. It is possible for a module to be less than 2400 mm in width; in that case it may be advantageous for modules to be connected together side-by-side for transport. For example two modules, each of about 1250 mm in width could be connected in this way.

Especially in the case of relatively long modules, it may also be advantageous to place fastening elements partway along top and bottom side edges of the module. That may facilitate handling and transport and may also be used for connections to foundations or adjacent modules, as described above.

Where the overall width of the module exceeds the range of 2350 mm to 2500 mm given above, it is preferably up to 1.5 or 2 times that width, and therefore preferably up to 4900 mm. If a module is not more than 3660 mm (1.5 times standard width) that has the advantage that two modules placed side-by-side then occupy the space that would typically be allocated to three freight containers placed side-by-side, namely up to about 7400 mm total width. For modules greater than 3660 mm wide and up to 4900 mm wide, the space used for one module would be the space typically allocated for two standard containers placed side-by-side. That can for example facilitate transport of the modules by a container ship or other vessel.

Other dimensions of the module may also be matched to those of a freight container. Such containers are commonly of lengths of 10 ft (2991 mm), 20 ft (6058 mm), 30 ft (9125 mm), 40 ft (12192 mm), 45 ft (13716 mm) or, especially in USA and Canada, up to 53 ft (17154 mm). The overall length of the module is most likely to be in the range of 6000 mm to 6100 mm, in the range of 12100 mm to 12300 mm or in the range of 13600 mm to 13800 mm, those being the most commonly used dimensions for freight containers.

For lengths of module greater than 40 ft (12192 mm), fastening elements are preferably provided at the same positions longitudinally as on a standard 40 ft (12192 mm) container to allow lifting and vessel stowage using equipment of standard dimensions and with standard vessel stowage arrangements.

Preferably the exterior of the module is fitted with a plurality of additional fastening elements for interfacing with an external wall cladding system and/or a roofing system. In that way the addition of a wall cladding system or a roofing system may be greatly facilitated. The additional fastening elements are preferably secured to one or more of the elongate members. Such additional fastening elements can be of the same or different design from the fastening elements that are, or act as, the standard castings of a freight container. The fastening elements may also be used for fixing other structural elements such as balconies, corridors, stairs or bridging elements to the module.

The description above has been provided principally with reference to a building module according to the first particular aspect of the invention. It should be understood that the many features described above can also be incorporated advantageously in a module which differs in some respect from the module of the first particular aspect of the invention, for example because it has an overall exterior width of less than 2700 mm. According to a broad aspect of the invention there is provided a building module having an exterior shape generally of a cuboid having side, end, top and bottom faces, and fabricated from metal, the module being hollow and defining a space of a size suitable for occupation by a person, the module including fastening elements to allow the module to be fastened to another adjacent module.

Such a module may further incorporate any of the features described above of the module according to the first particular aspect of the invention.

An important aspect of the invention is that the modules are not usually employed individually but rather are fastened together as a multiplicity (a "multiplicity" as used herein refers to three or more) of modules. Thus the present invention further provides a multiplicity of modules for fastening together to form part or all of a building, each module having an exterior shape generally of a cuboid having side, end, top and bottom faces, being hollow and defining a space suitable for occupation by a person.

The modules may all be of the same dimensions but it may also be the case that their dimensions vary, especially in terms of their widths and lengths. Conveniently, at least the majority of the modules have a width which is approximately one, two or three times a given unit width. For example the given unit width may be 1220 mm, some modules may have a width of about 2440 mm and some modules may have a width of about 3660 mm and some may even have a width of about 4880 mm. Similarly, at least the majority of the modules may have a length which is approximately one, two, three, four or five times a given unit length. In particular applications it may be desirable for a module to be of exceptionally short length and there may therefore be at least one module which has a length which is less than one fifth of the length of the longest module. The short module may be transported with another longer module and result in a combined length that matches a standard length and therefore facilitates transport.

At least the majority of the modules may be of approximately the same height. That may be advantageous in the case of a group of modules for use in the same building. The preferred height of module may vary from one design of building to another, or from one part of a building to another. A module may also be provided in a flat pack form and sides of the module erected on site.

Preferably there is further provided a foundation interface having a lower face for resting on foundations and an upper face carrying connector elements for engagement with fastening elements on modules to fasten the modules to the foundation interface. The lower face of the foundation interface can be connected to the foundations in a conventional manner and is then able to provide the special fastening arrangement for engaging fastening elements on the modules. The connector elements can engage the fastening elements in the same manner as described above in respect of the connector elements connecting two modules together. The foundation interface may be in the form of one or more rectangular rings, opposite ends of a module resting on opposite sides of a ring. An alternative arrangement is to fix the connector elements in appropriate locations directly onto conventional foundations.

Similarly an inter storey interface may be provided for placing between storeys of modules, the inter storey interface having a lower face carrying connector elements for engagement with fastening elements on modules in a storey immediately below the interface and having an upper face carrying connector elements for engagement with fastening elements on modules in a storey immediately above the interface. Again, the connector elements can engage the fastening elements of the modules in the same manner as described above in respect of the connector elements connecting two modules together. The inter storey interface may also be in the form of one or more rectangular rings.

Each module of the multiplicity of modules may include any of the features referred to above.

The present invention still further provides a building including a multiplicity of modules as defined above, the modules being fastened together to form part or all of a building with aligned openings in adjacent walls of adjacent modules to allow a person to move from one module to another.

The modules of the building may be fastened together in side-by-side relationship and/or in end-to-end relationship and/or there may be a plurality of storeys of modules, the modules in one storey being fastened to modules in an adjacent upper and/or lower storey.

The connected modules may provide the majority or all of the structural strength of the building, other structural elements such as cladding, roofing, balconies and stairwells being supported from the modules. For example, a roofed space and bridging corridors may be provided between two spaced apart groups of modules and supported by the modules. Another possibility is to connect a module that is without sides, ends or a top to adjacent modules to form a floor above which there may be open or covered space.

The invention still further provides a method of constructing a building at a site, the method comprising the following steps:

fabricating a plurality of modules at a location remote from the site, each module being generally in the shape of a cuboid and including fastening elements, transporting the fabricated modules to the site, and fastening together the fastening elements of modules to connect the modules together with aligned openings in adjacent walls of adjacent modules to allow a person to move from one module to another.

Preferably the fabricated modules are engaged by their fastening elements to secure them during transport. That facilitates the securing of the modules while they are being transported. Similarly, it is preferred that the modules are engaged by their fastening elements to move them into their final positions at the site.

The building that is constructed by the method of the invention is preferably a building comprising a multiplicity of modules and being as defined above.

Figure 2:
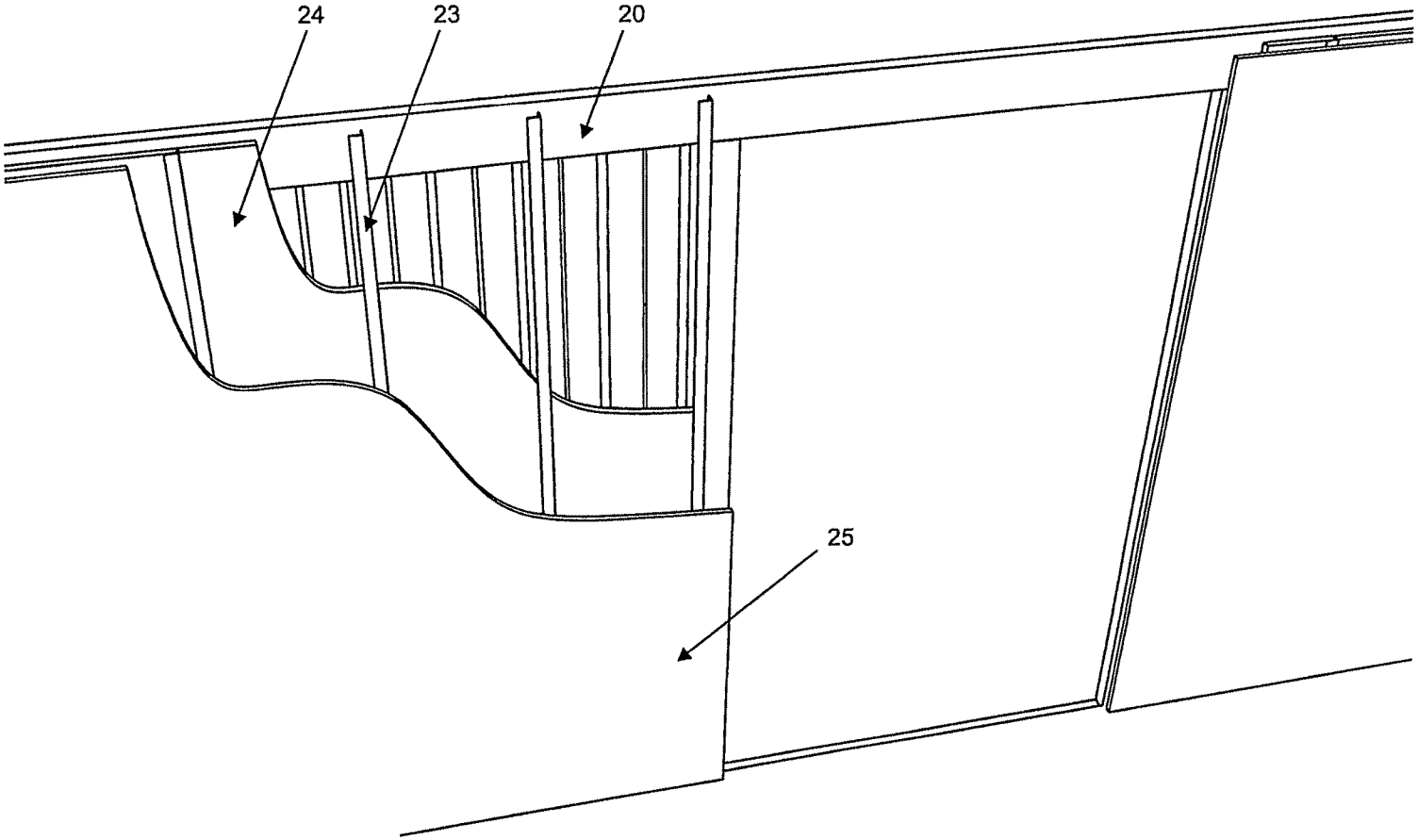
Figure 3:
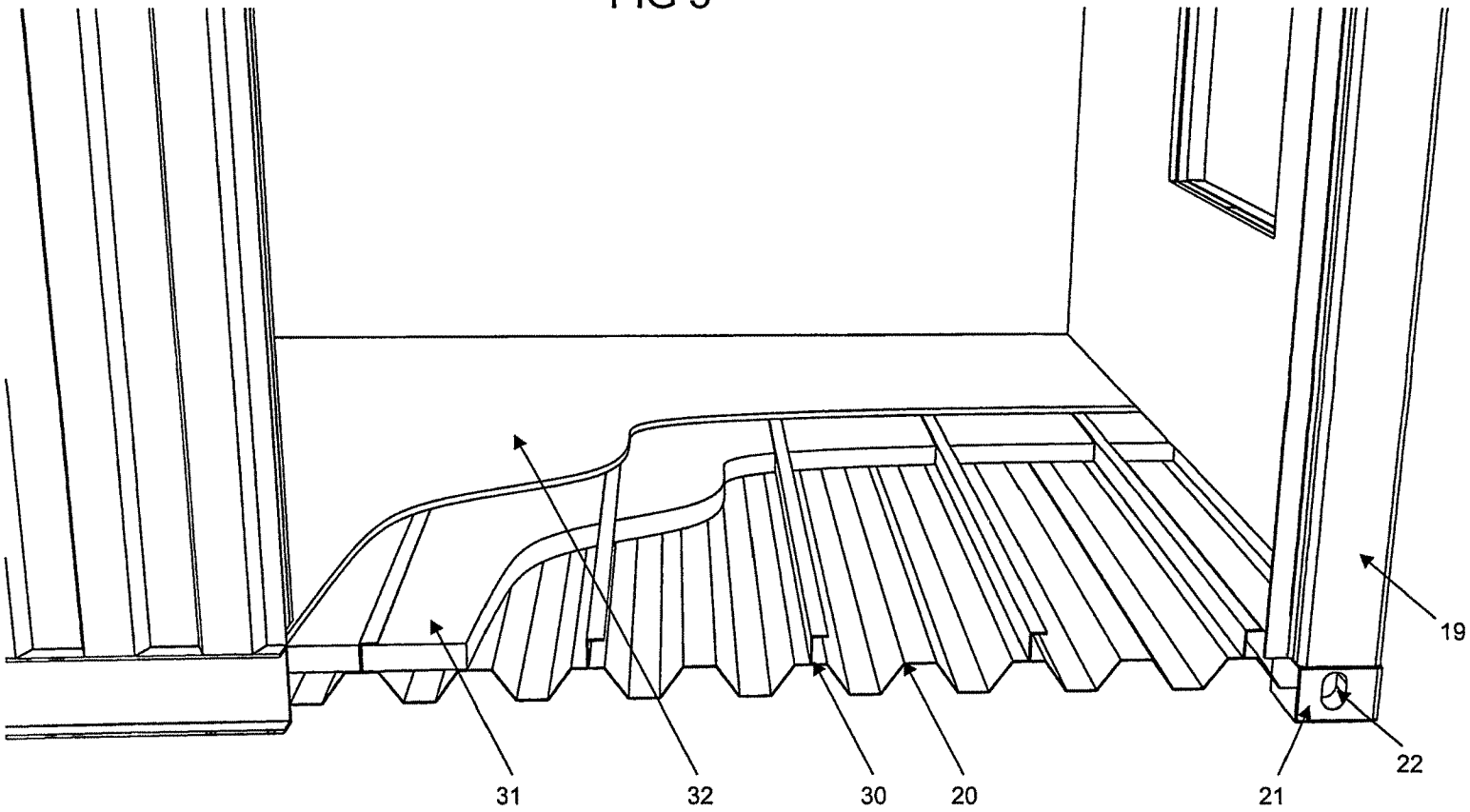
Figure 4:
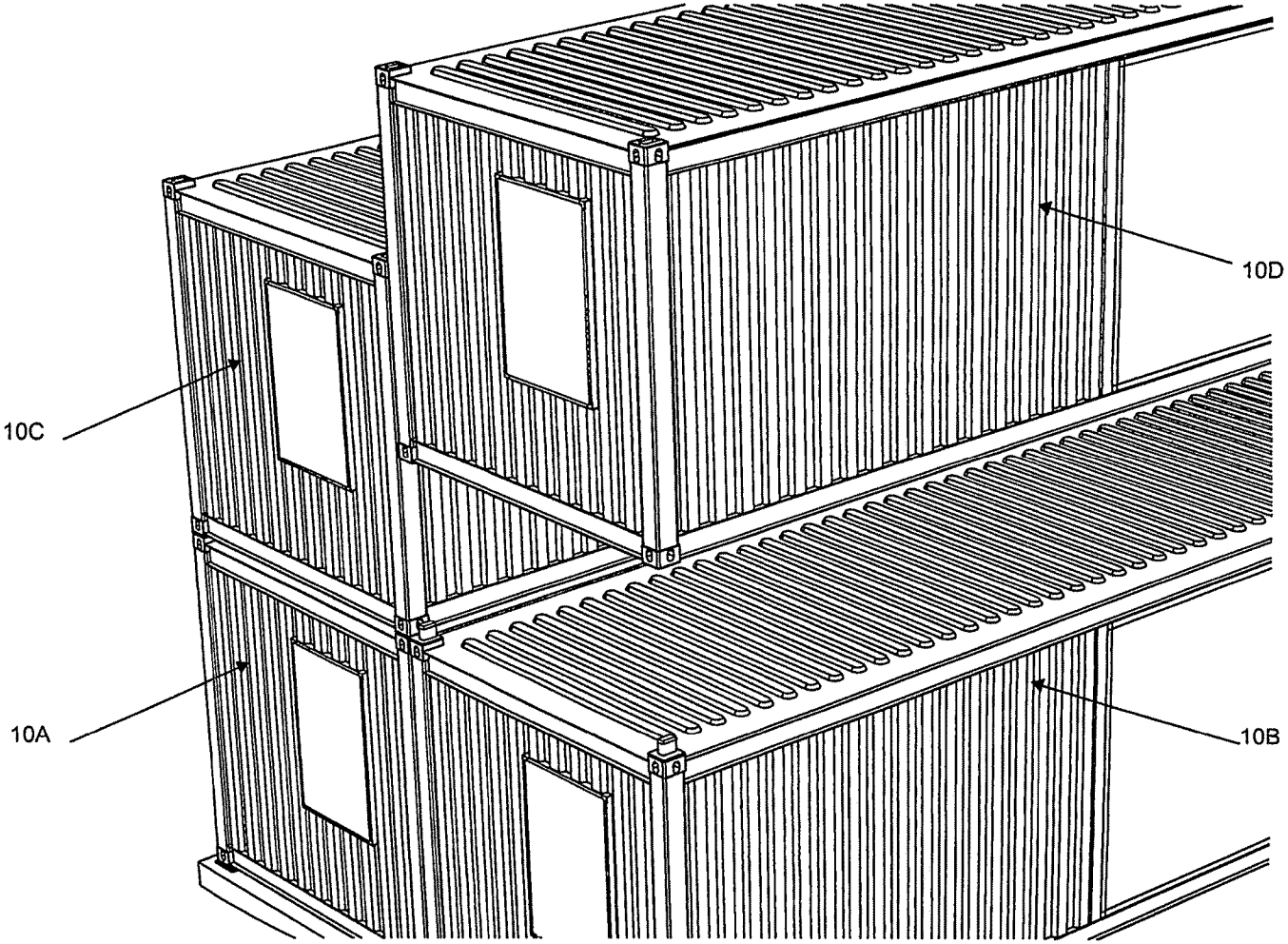
Figure 5:
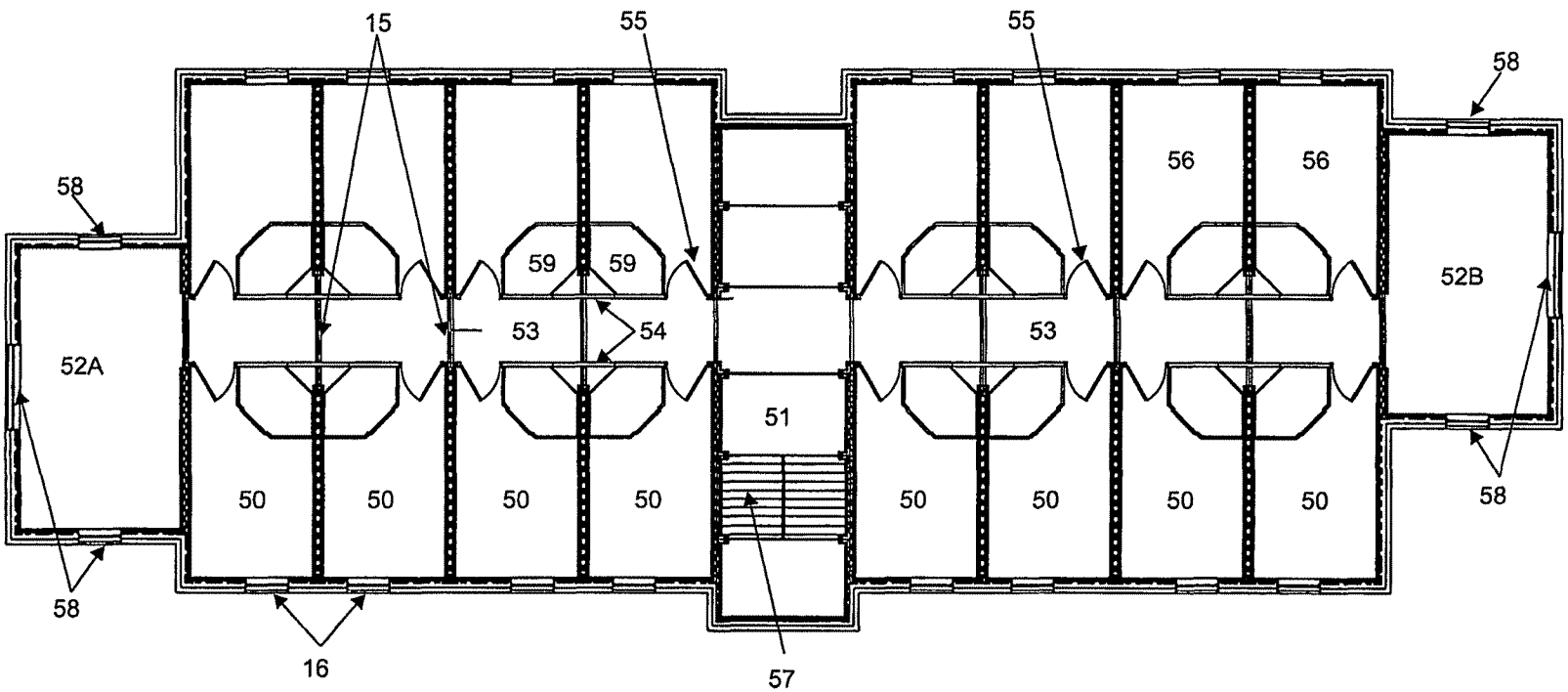
Figures 6A, 6B, 6C, 6D:
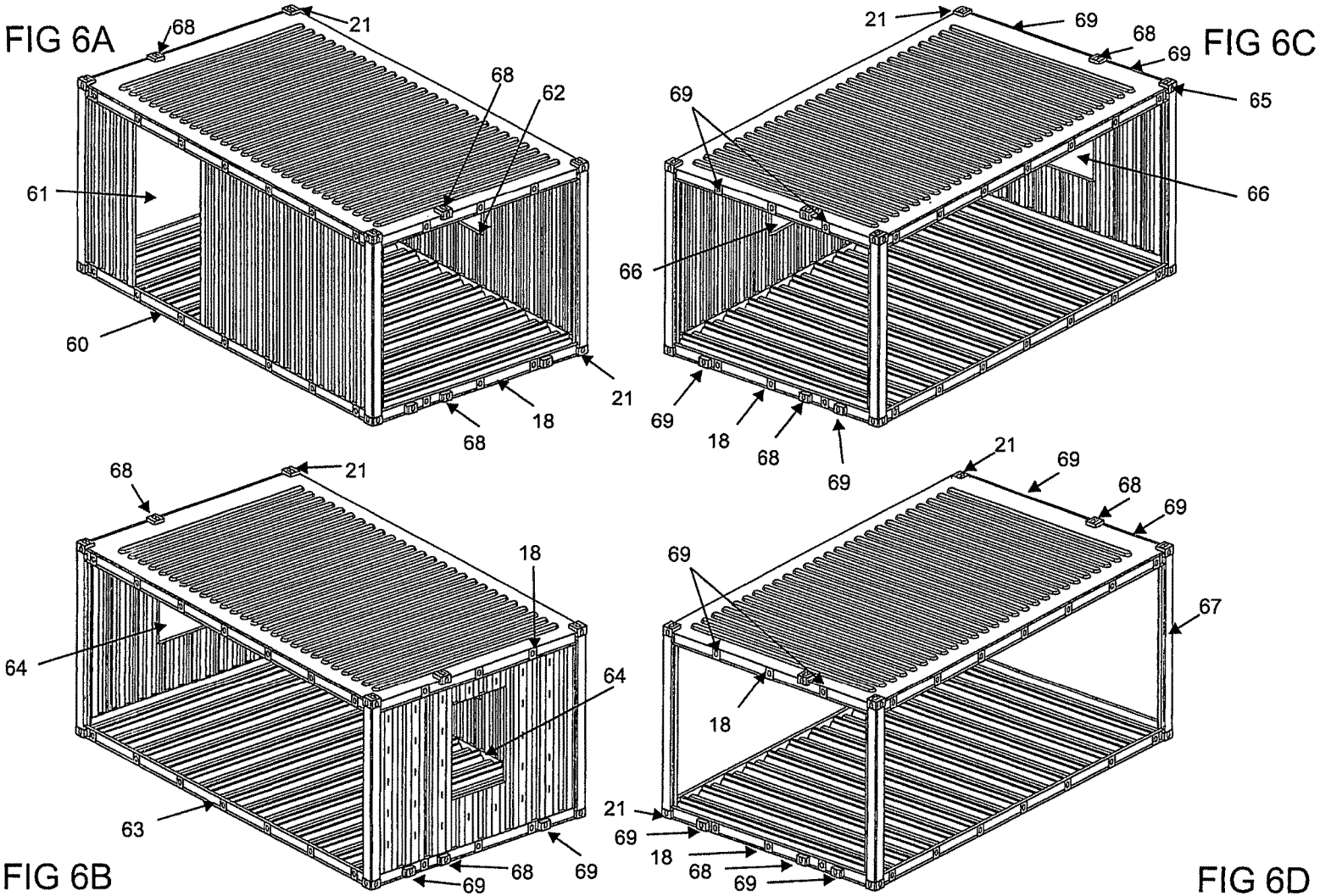
Figure 7:
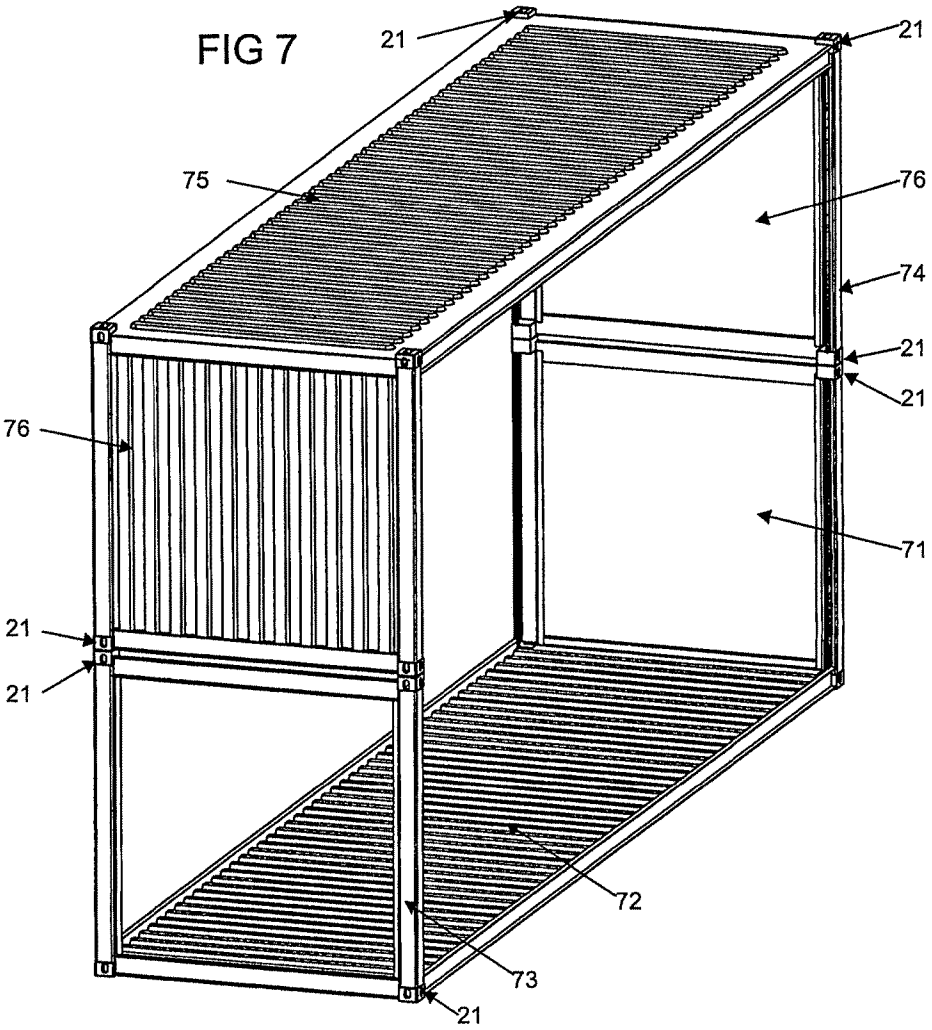
Figure 8A:
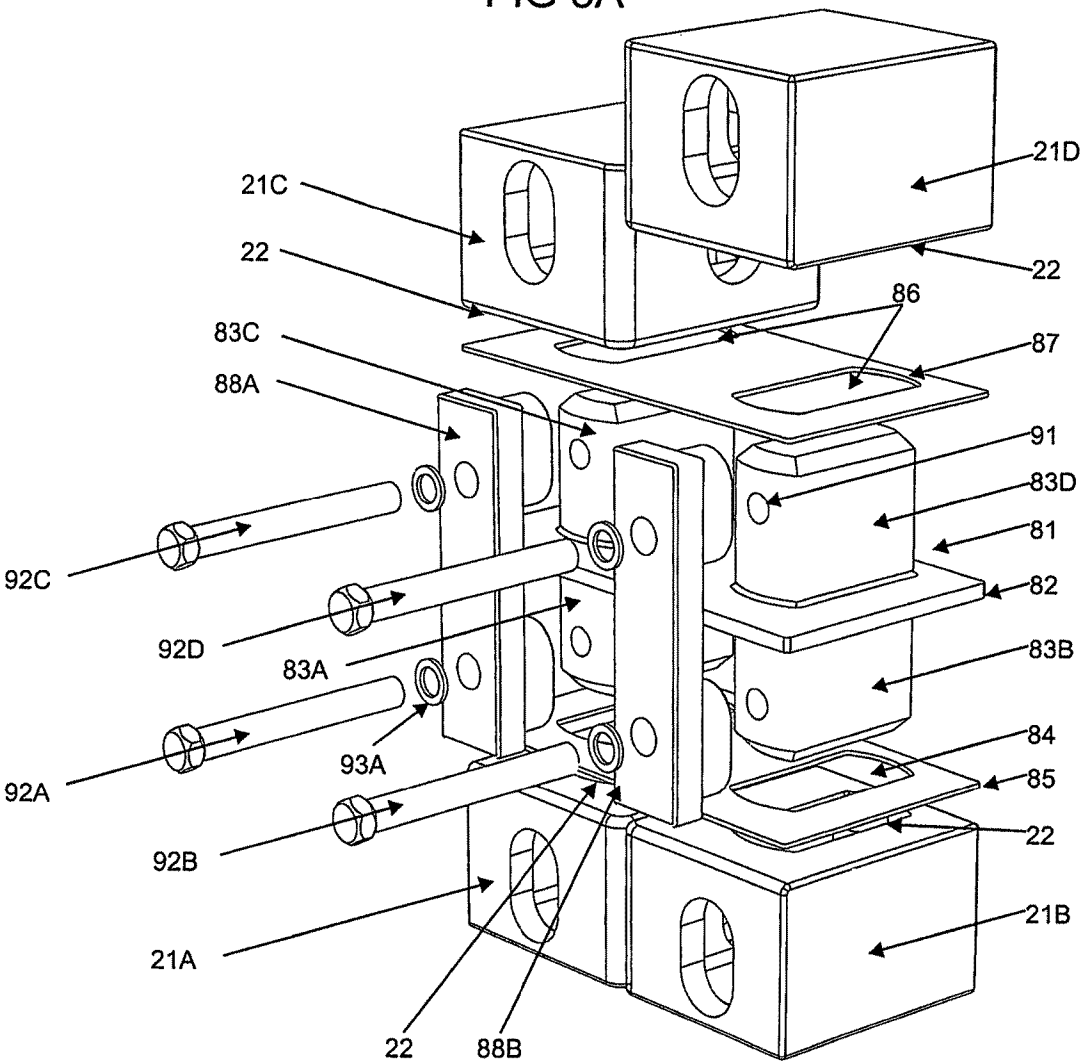
Figure 8B:
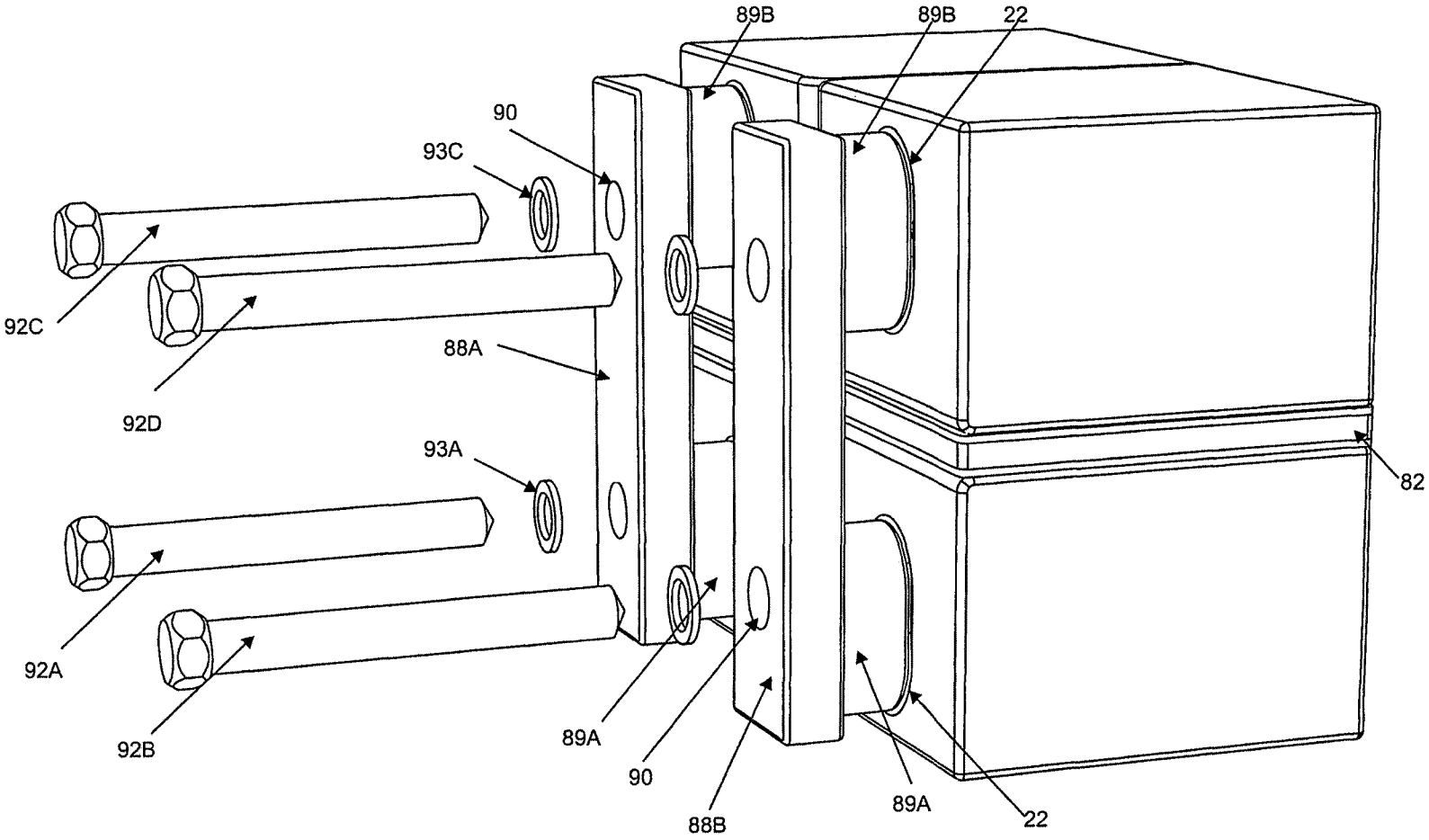
Figure 8C:
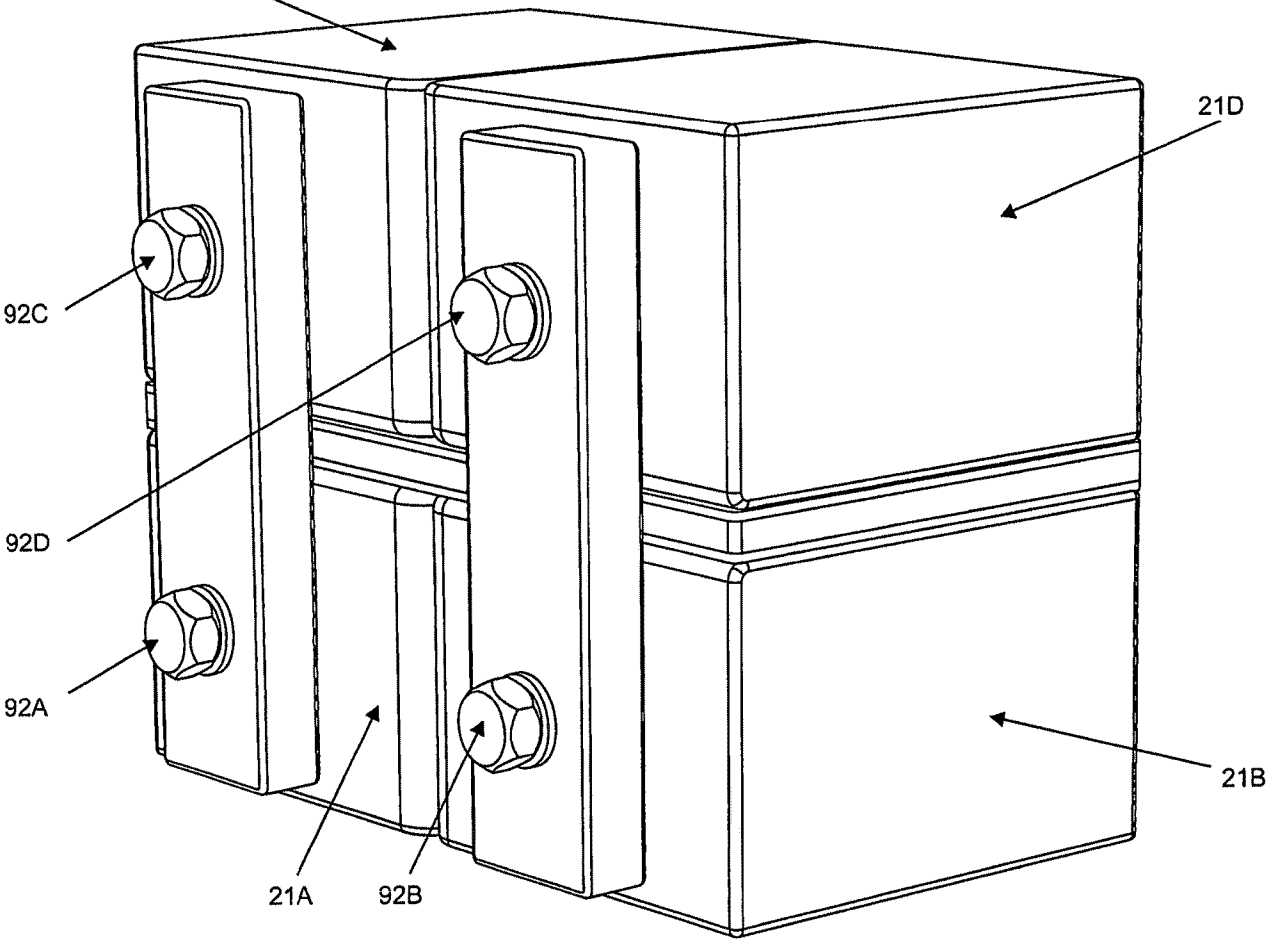
Figure 9B:
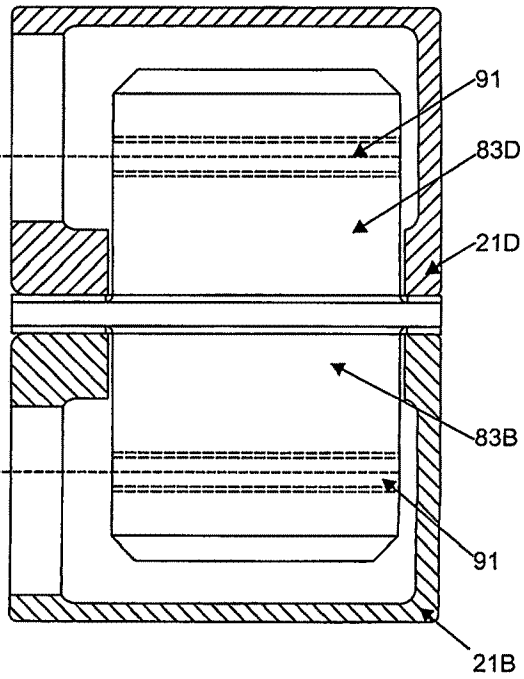
Figure 9A:
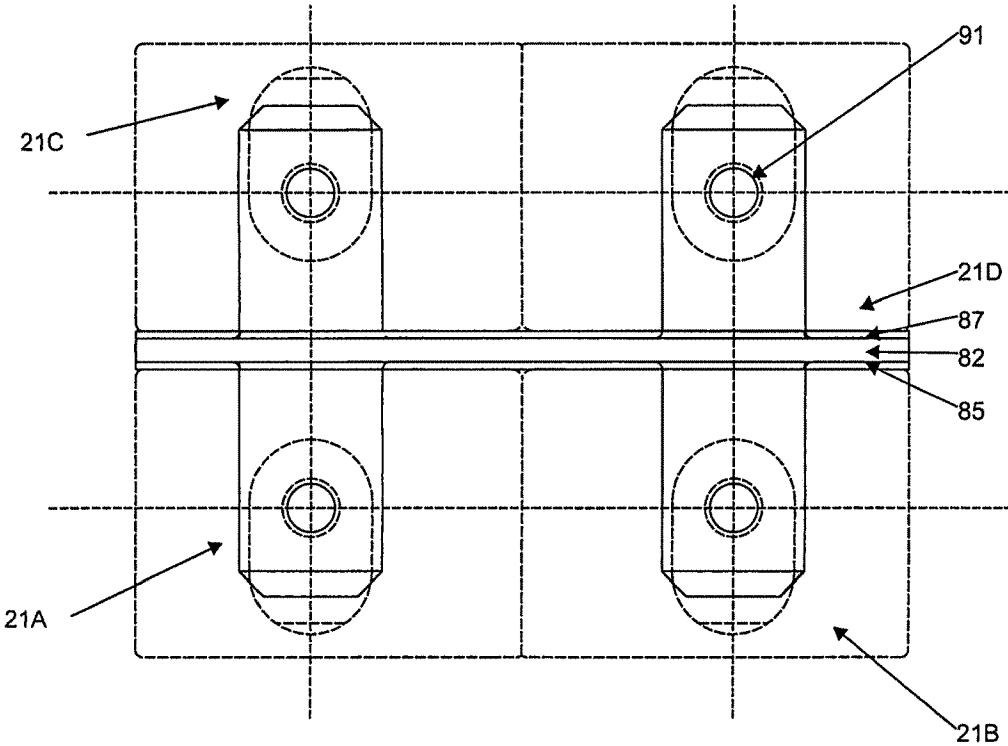
Figure 9C:
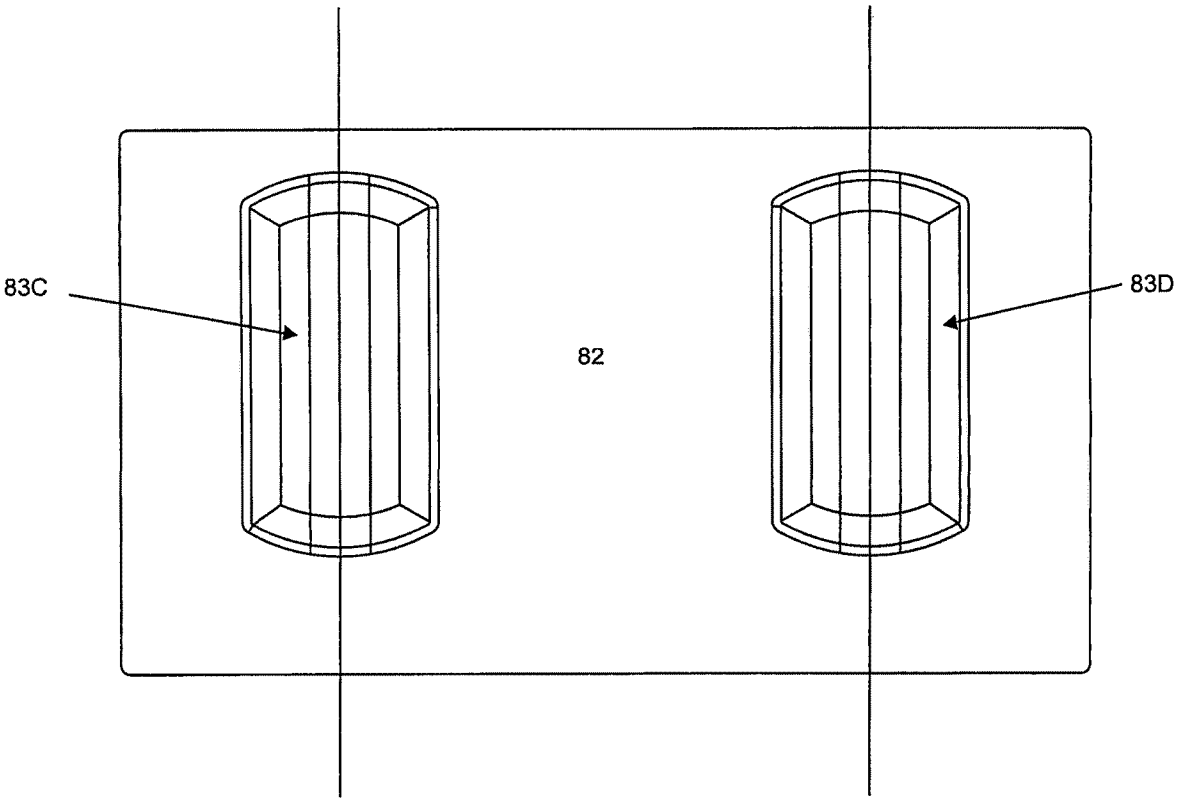
Figures 9D, 9E, 9F:
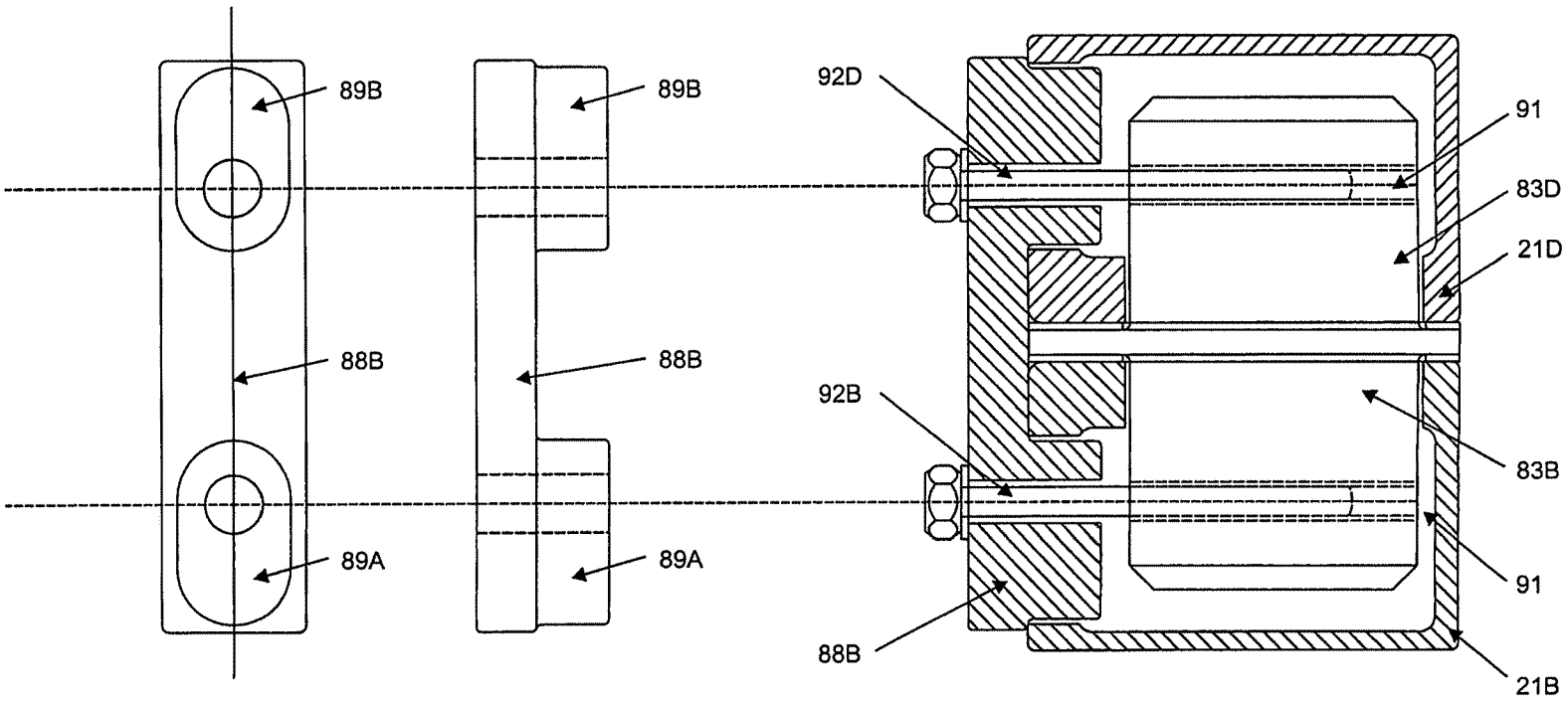
Figure 9G:
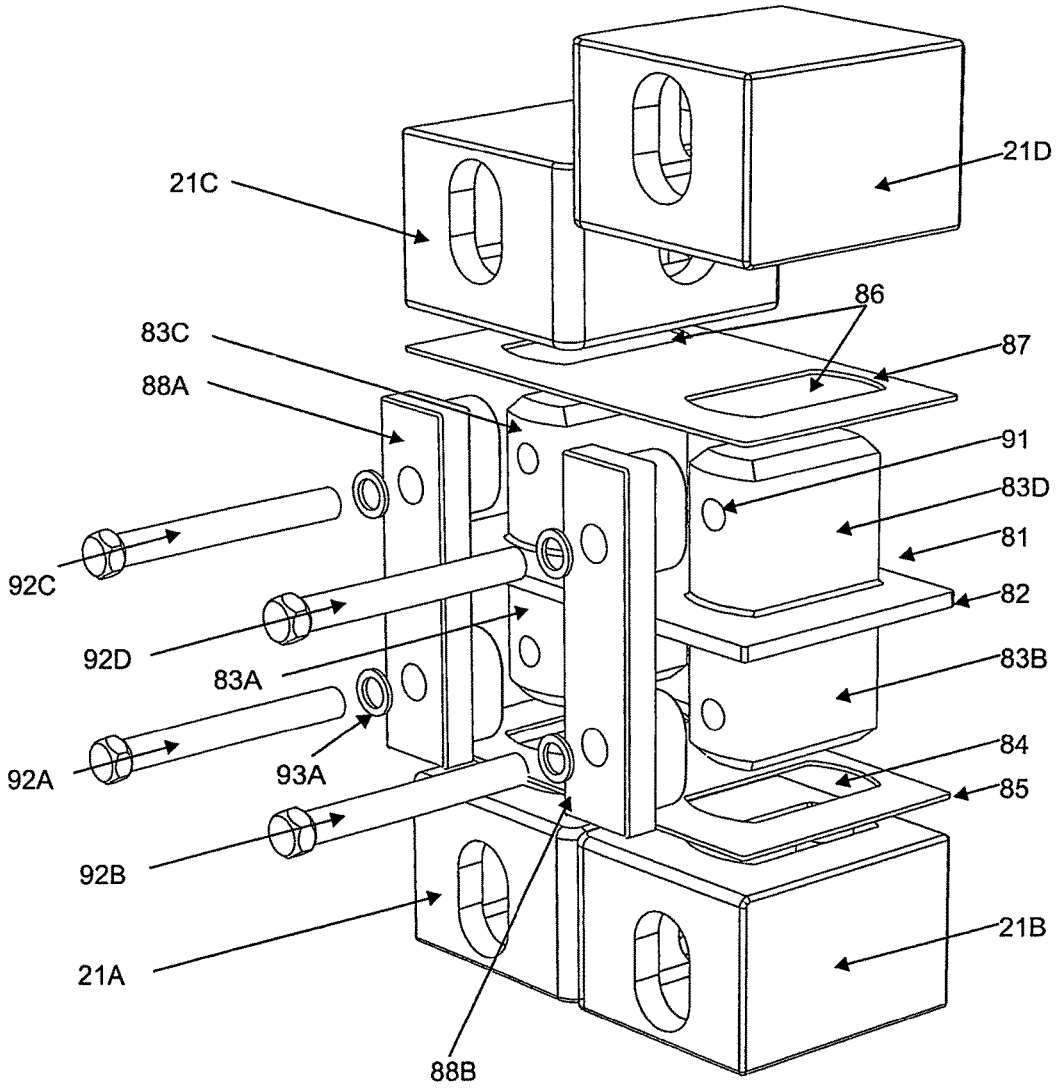
Figure 9J:
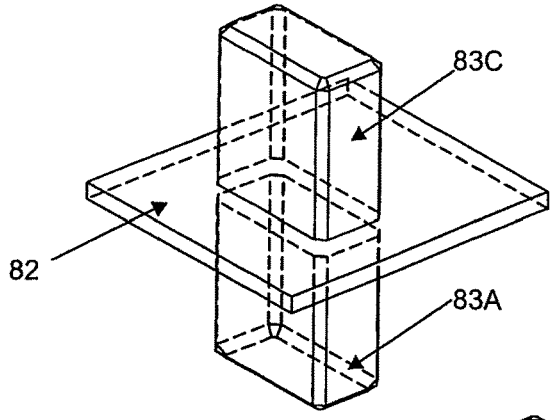
Figure 9H:
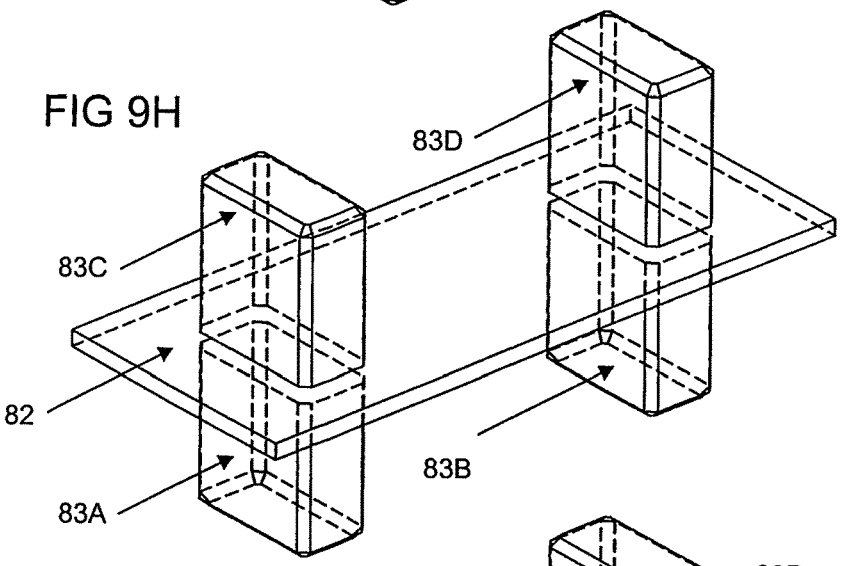
Figure 9K:
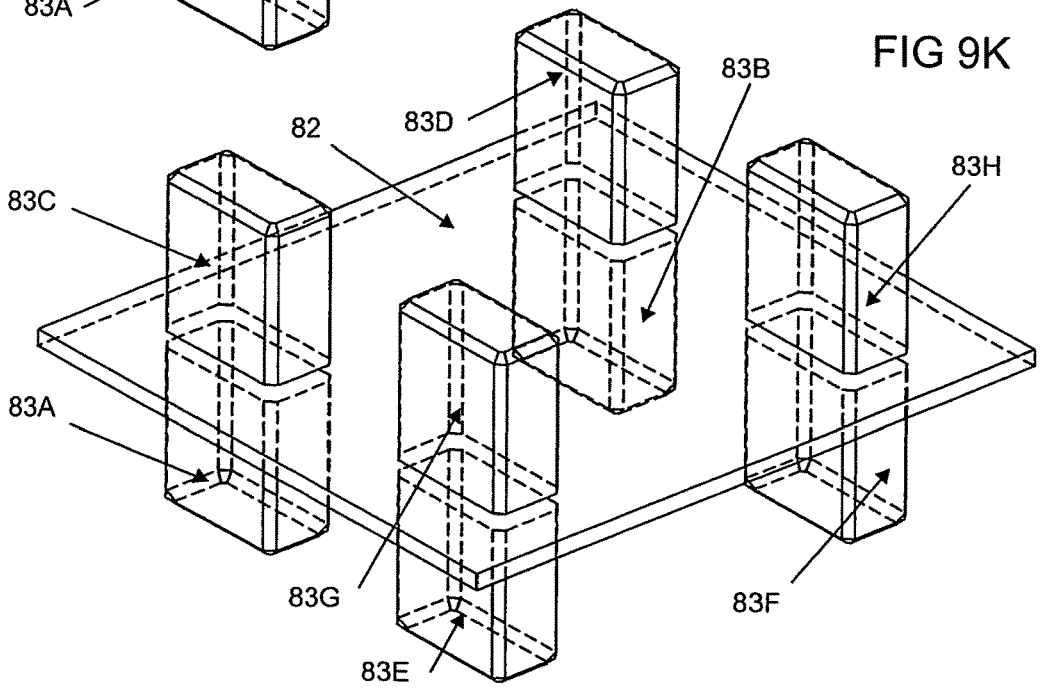
Figure 10:
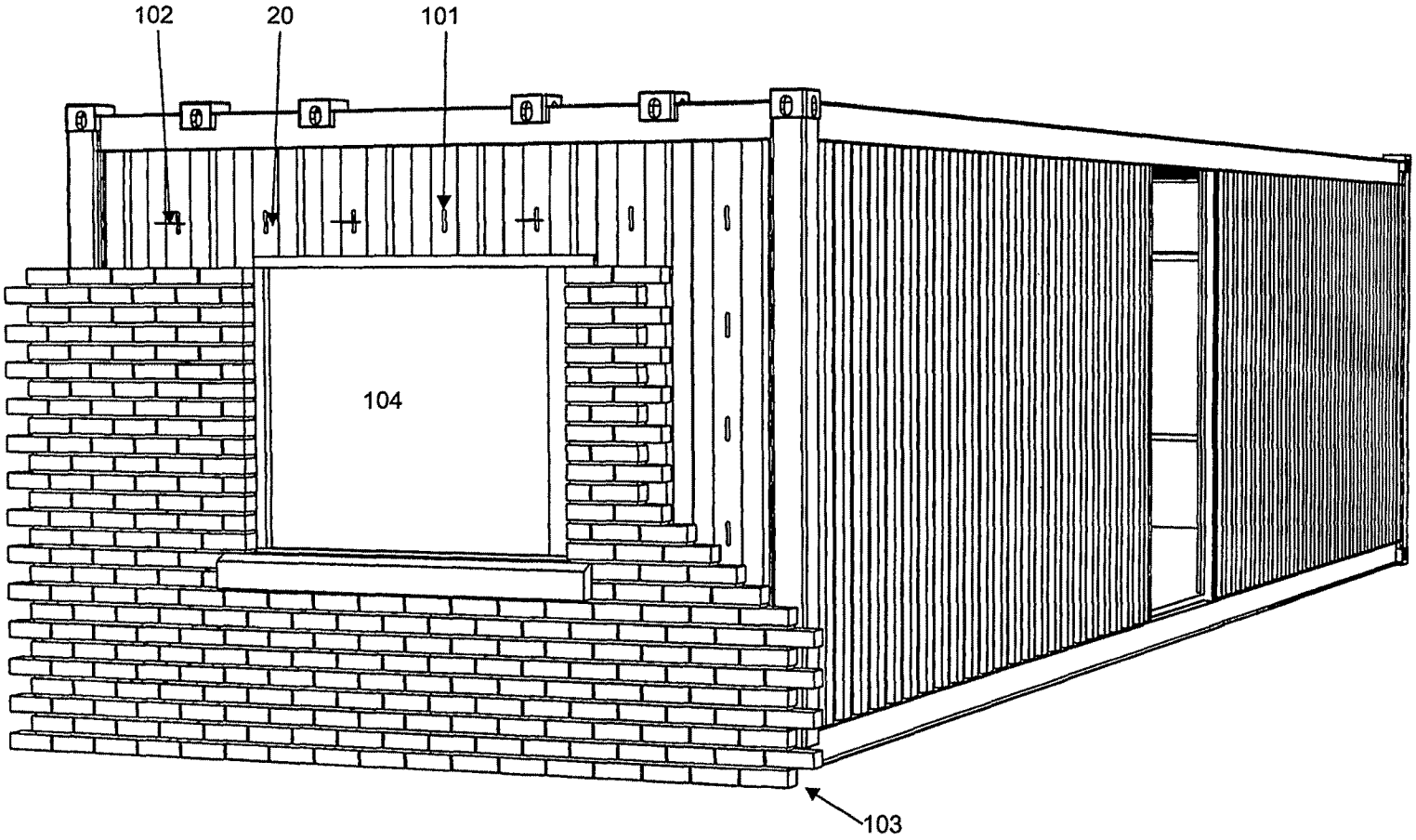
Figure 11:
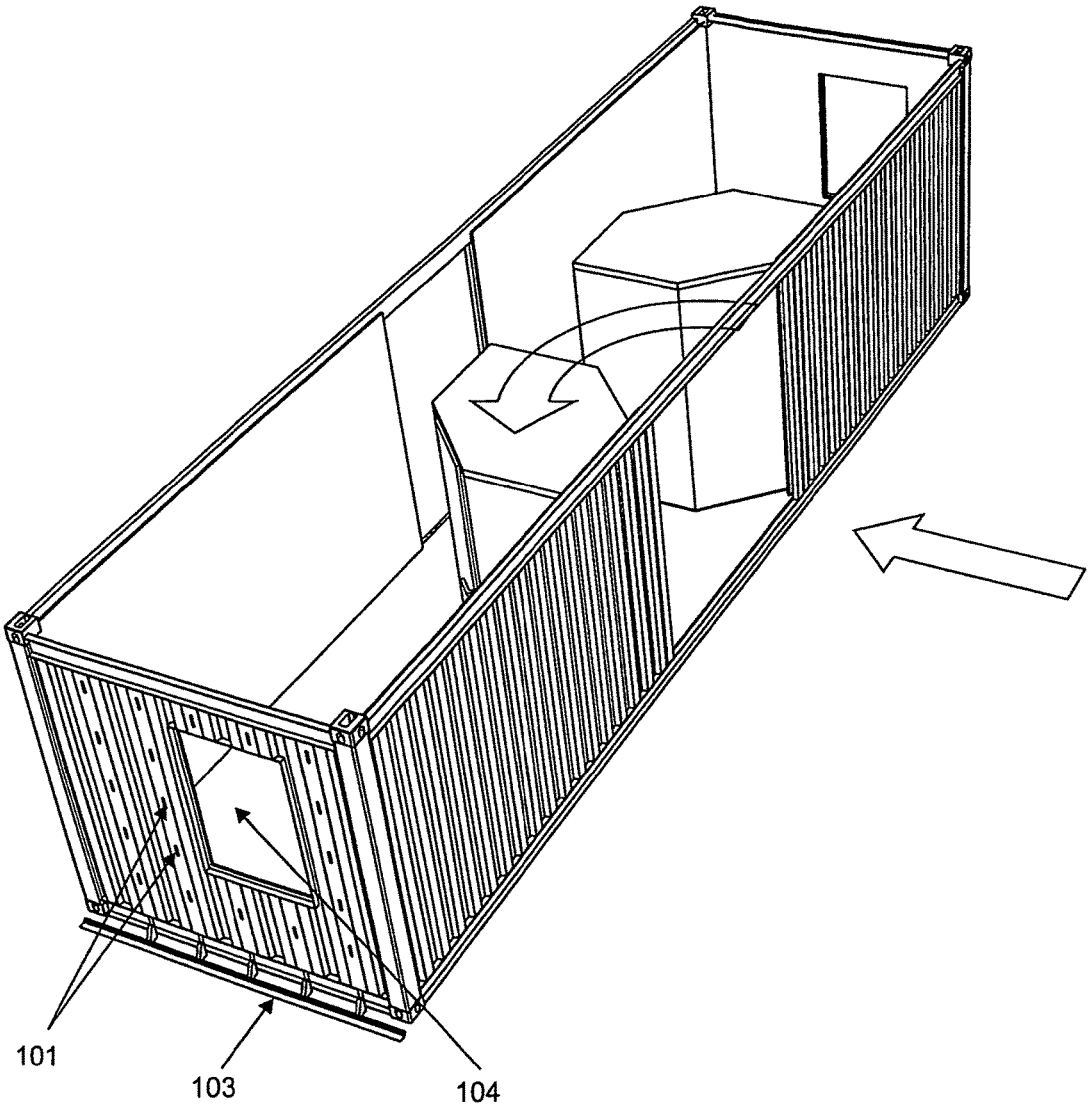
Figure 12A:
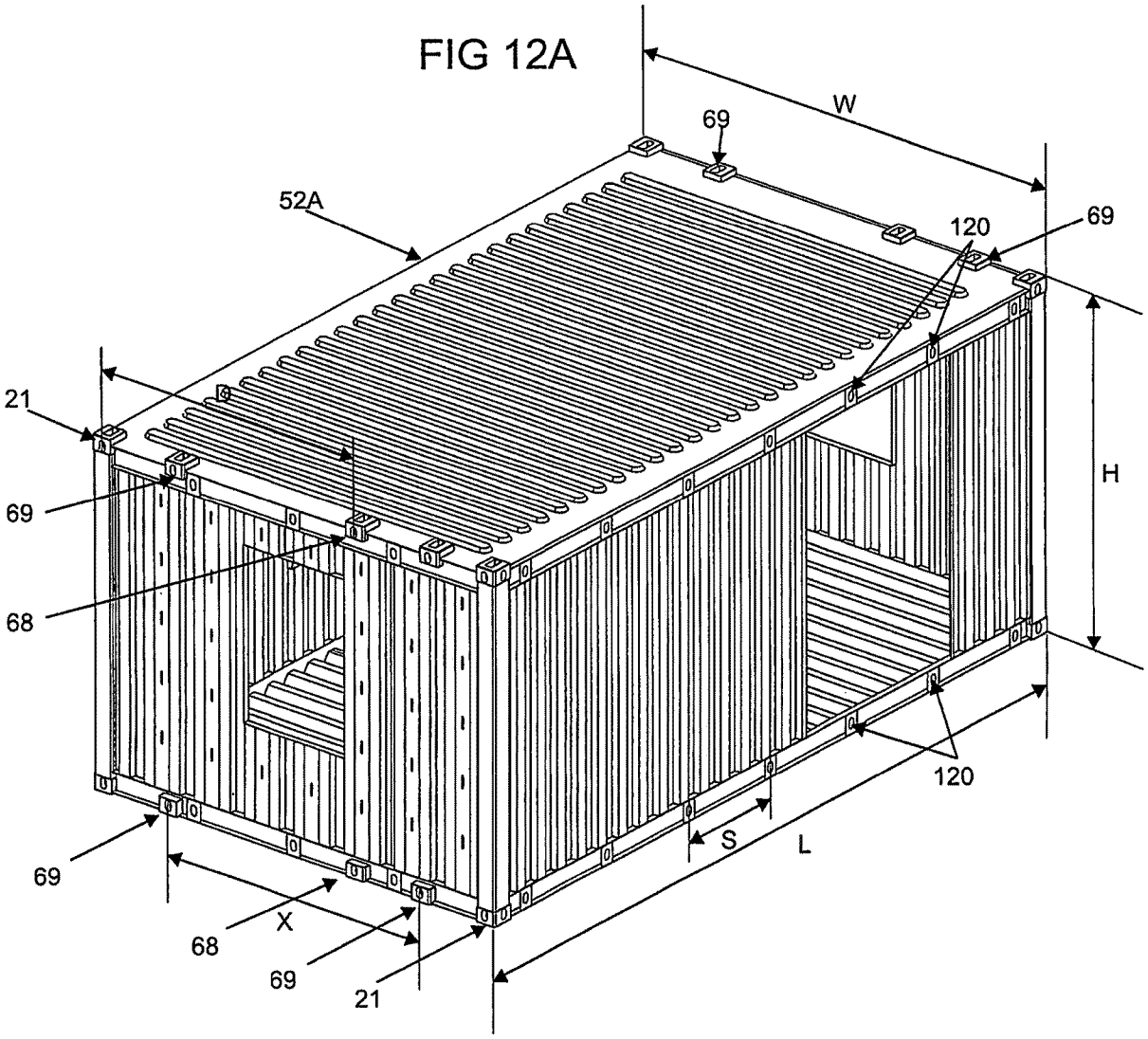
Figure 12B:
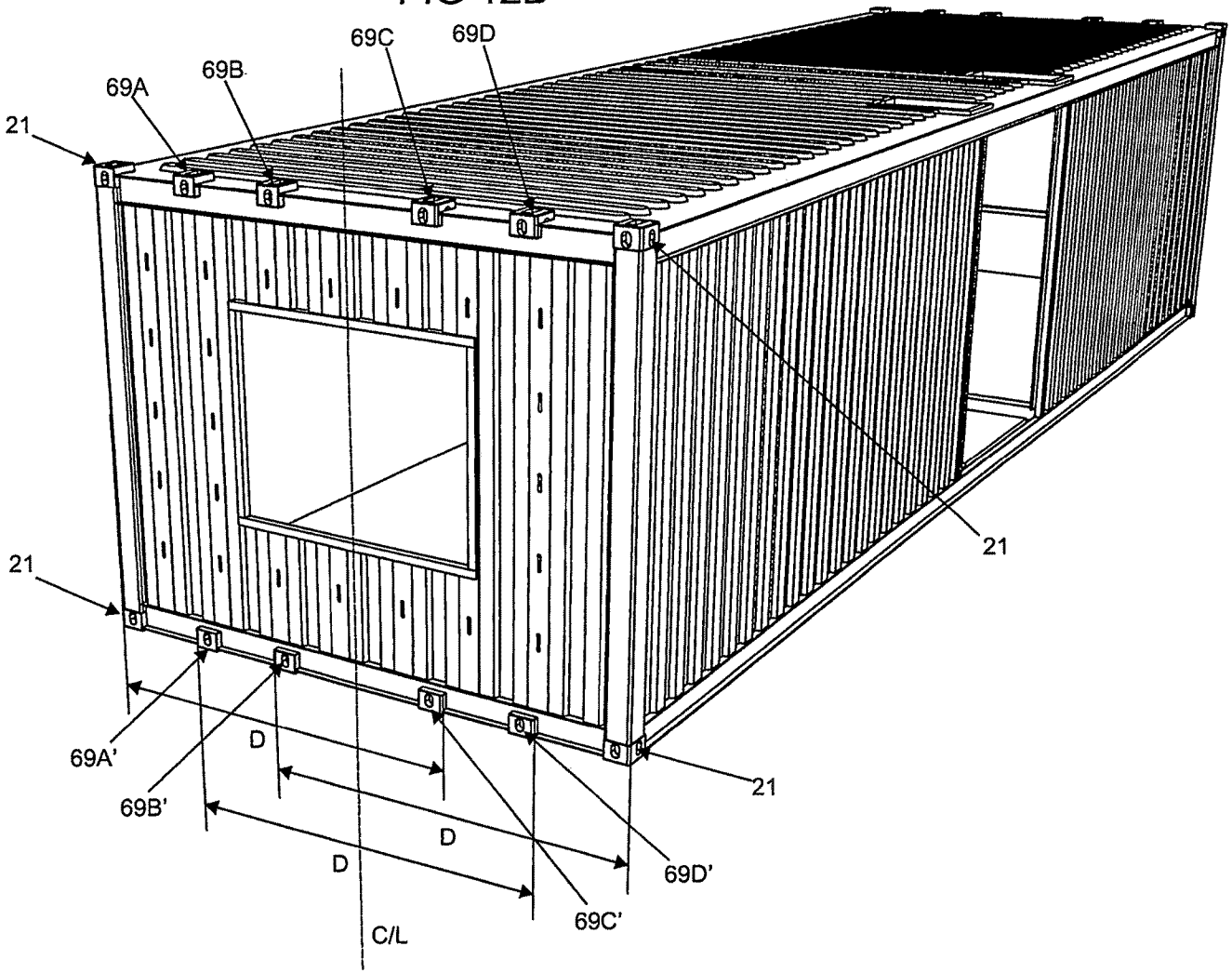
Figure 12C:
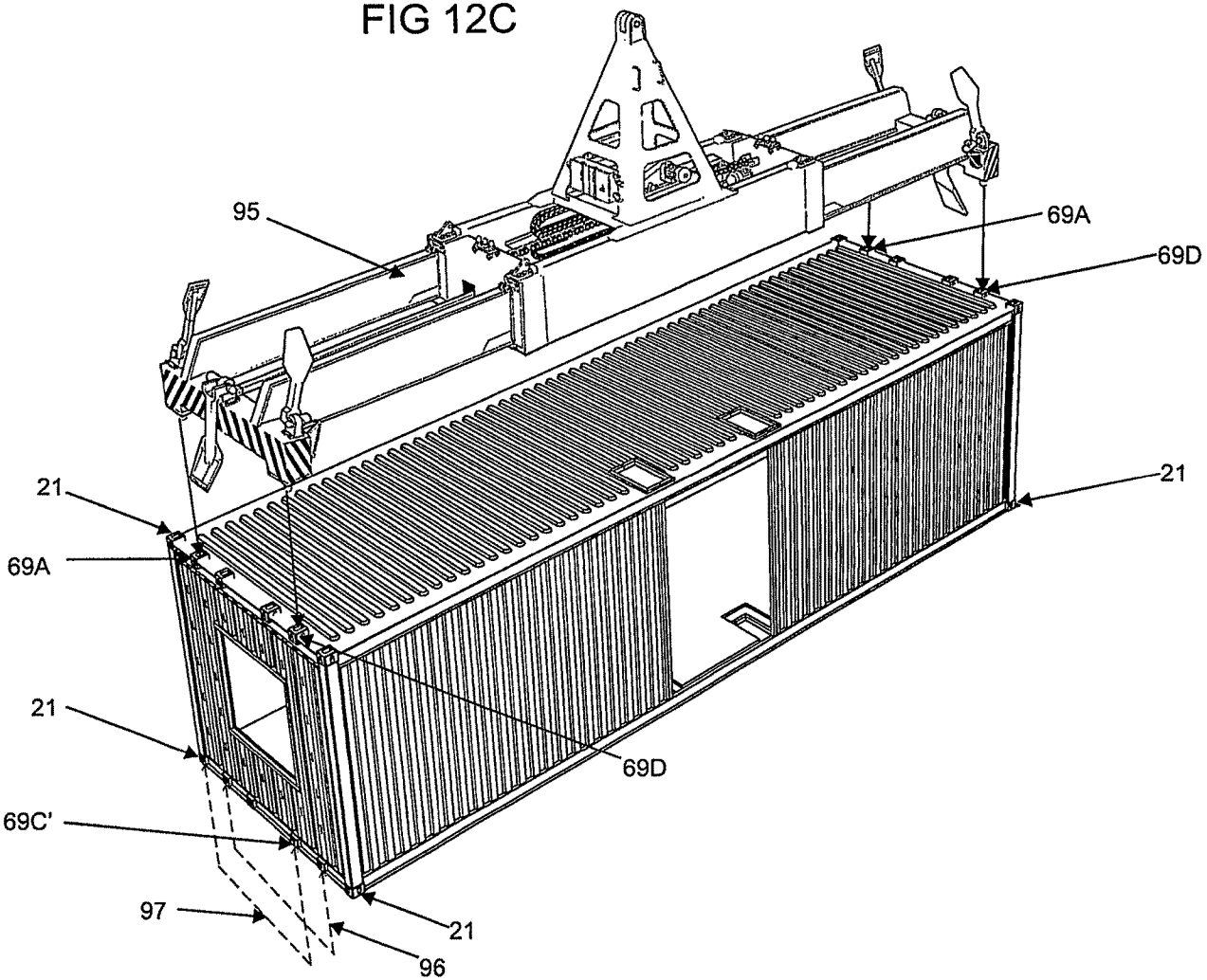
Figure 13:
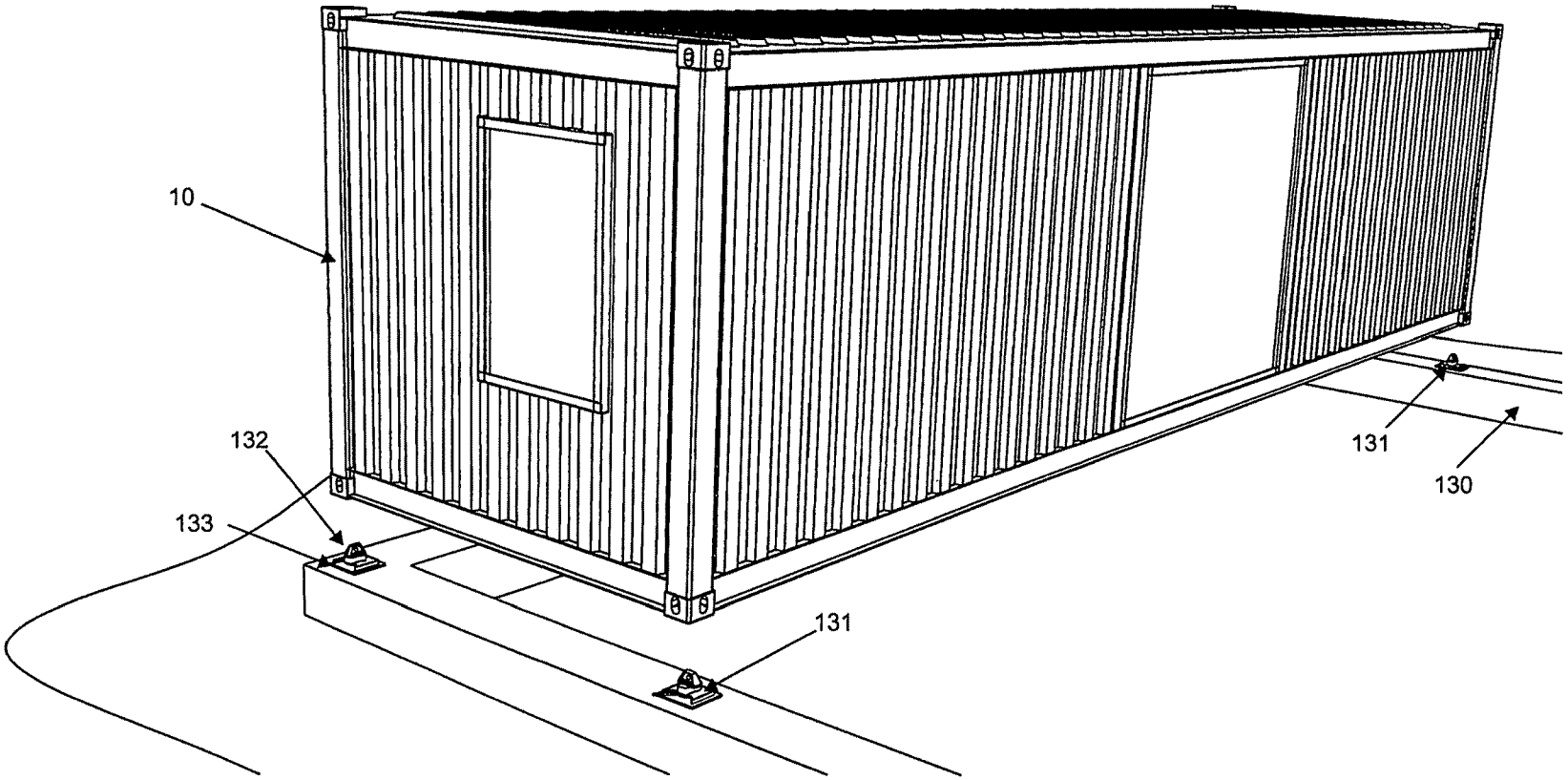
Figure 14:
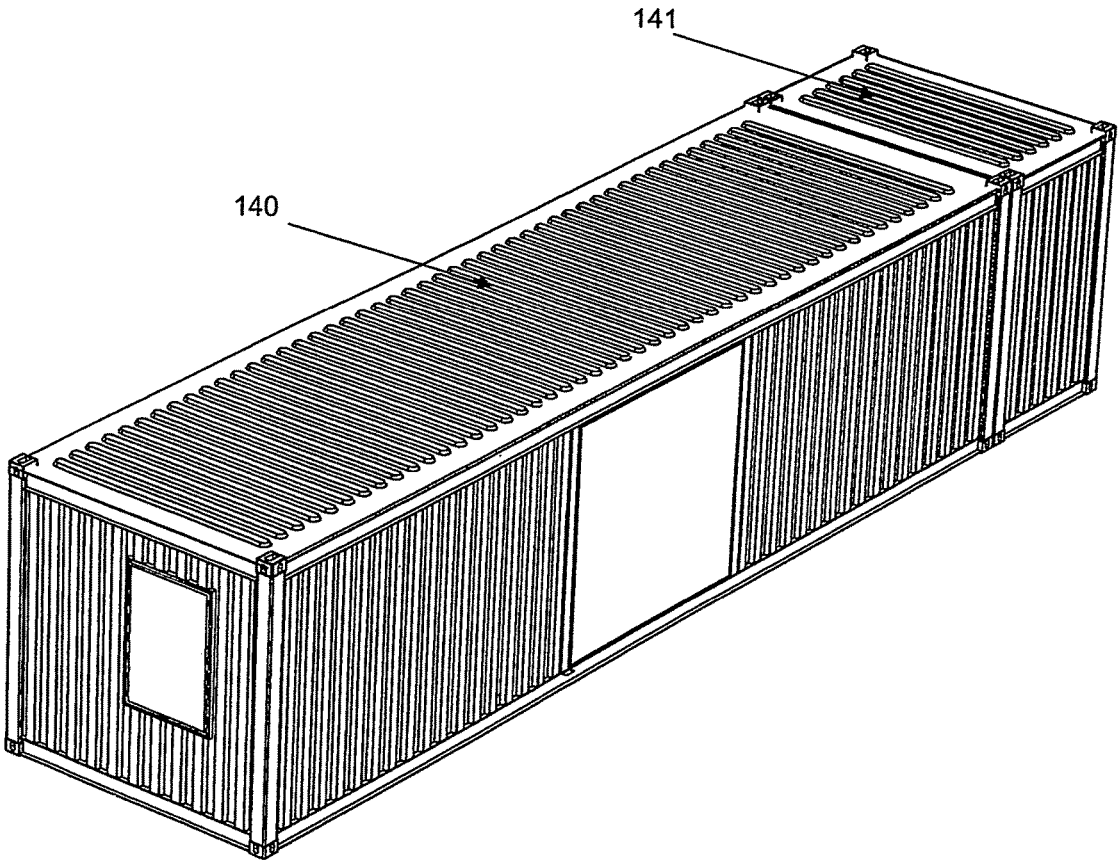
Figure 15:
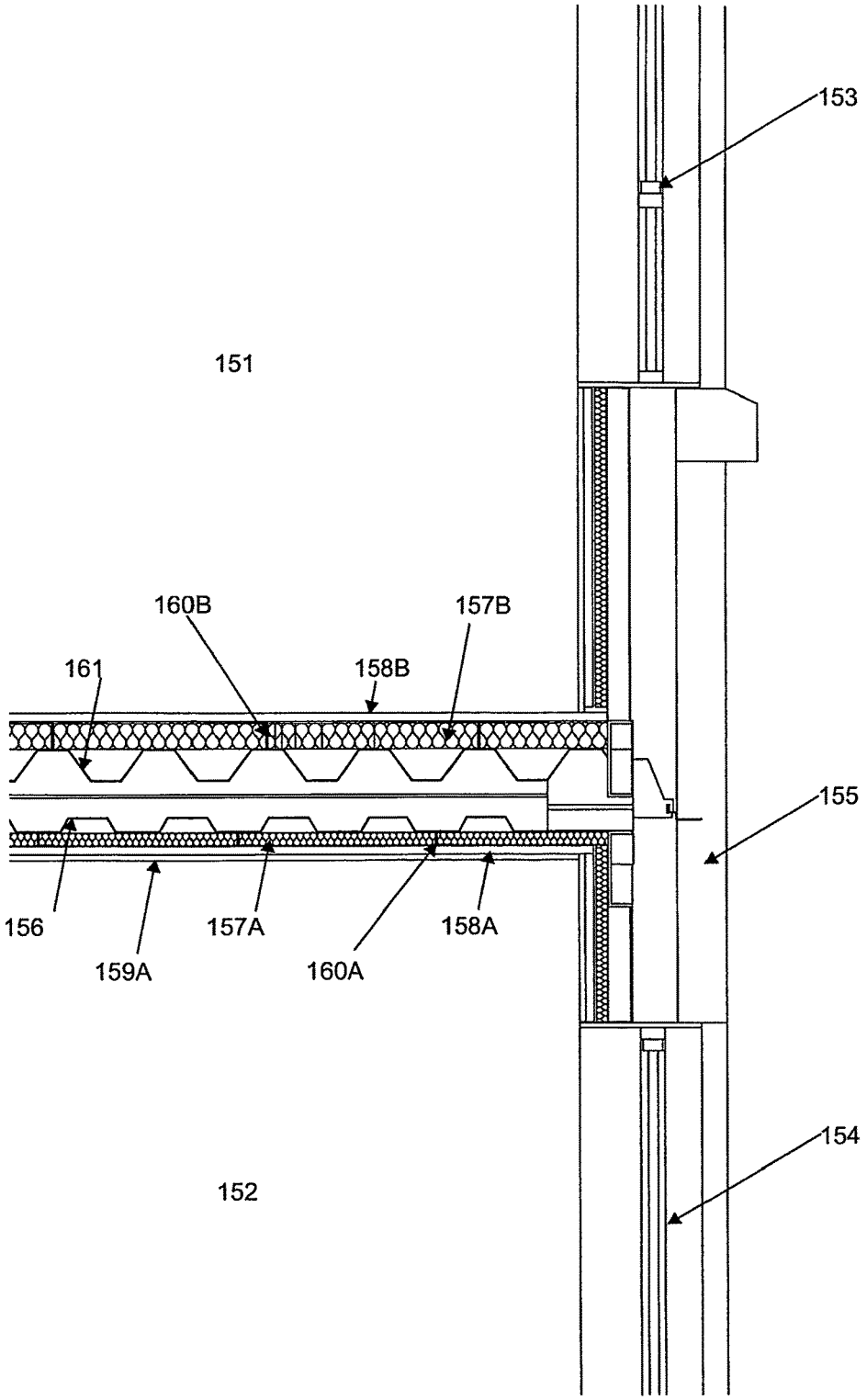
Figure 16B:
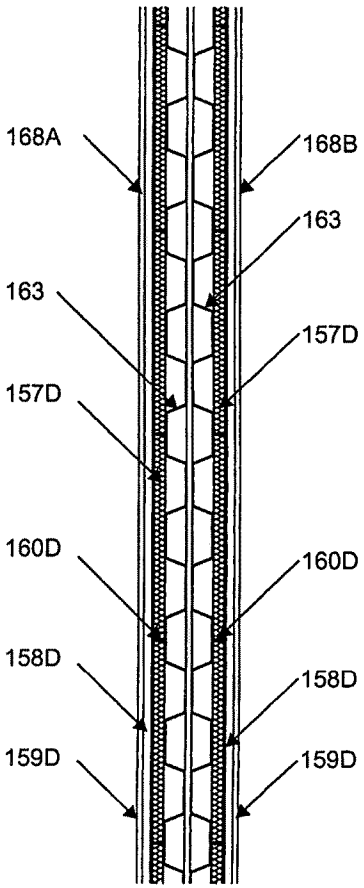
Figure 16A:
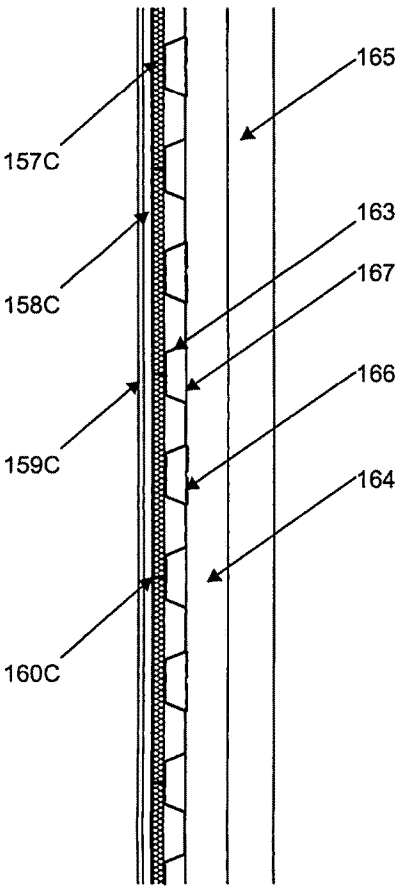
Figure 17A:
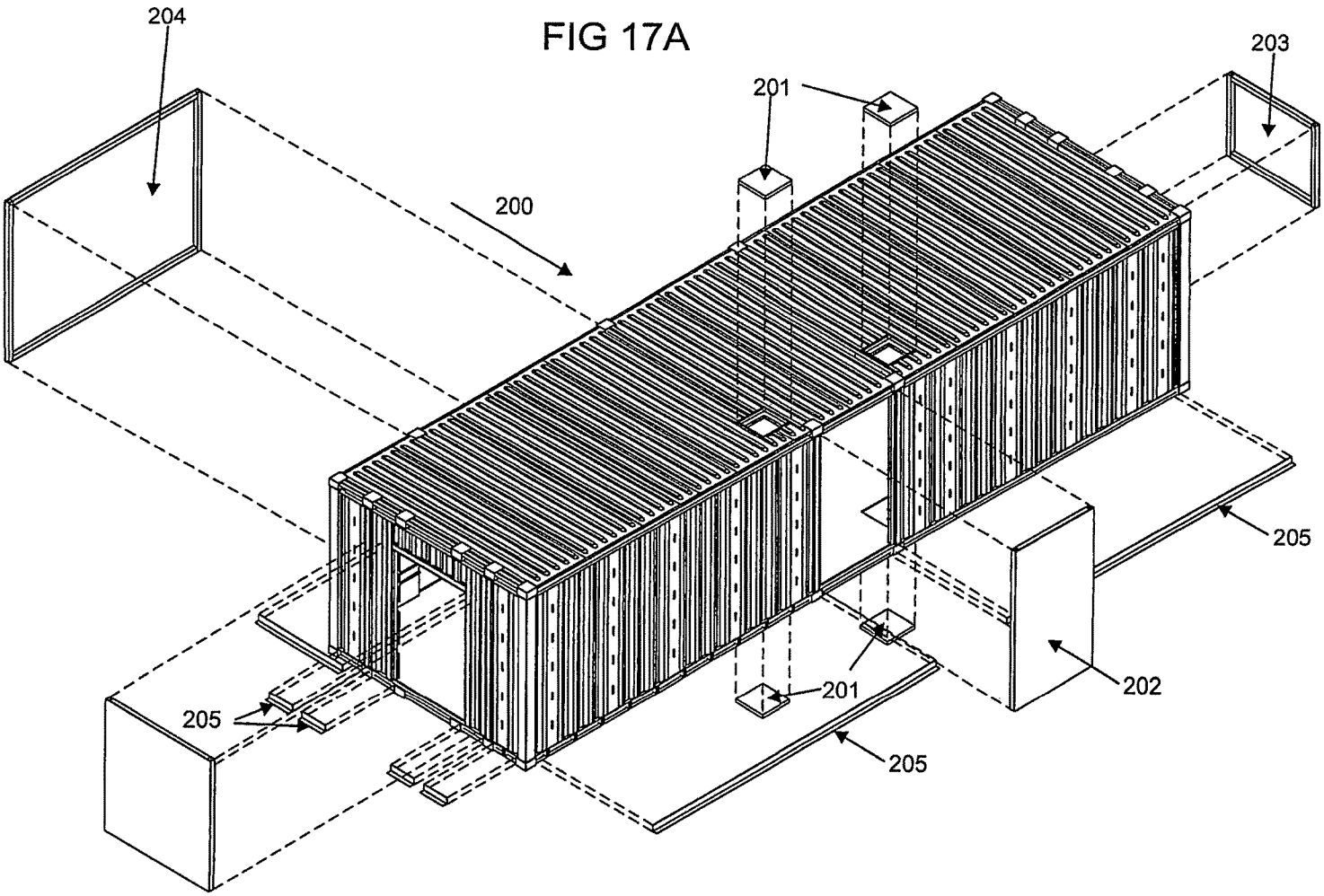
Figure 17B:
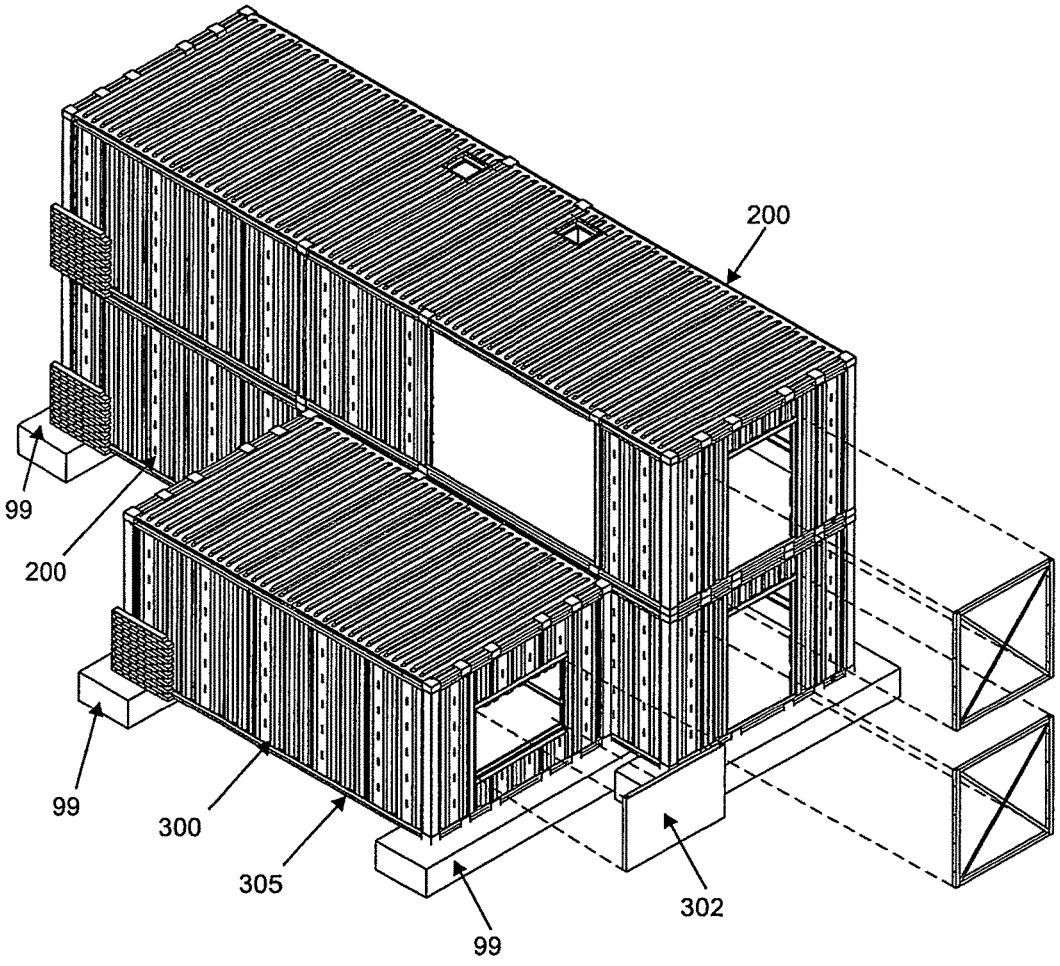
Figure 18B:
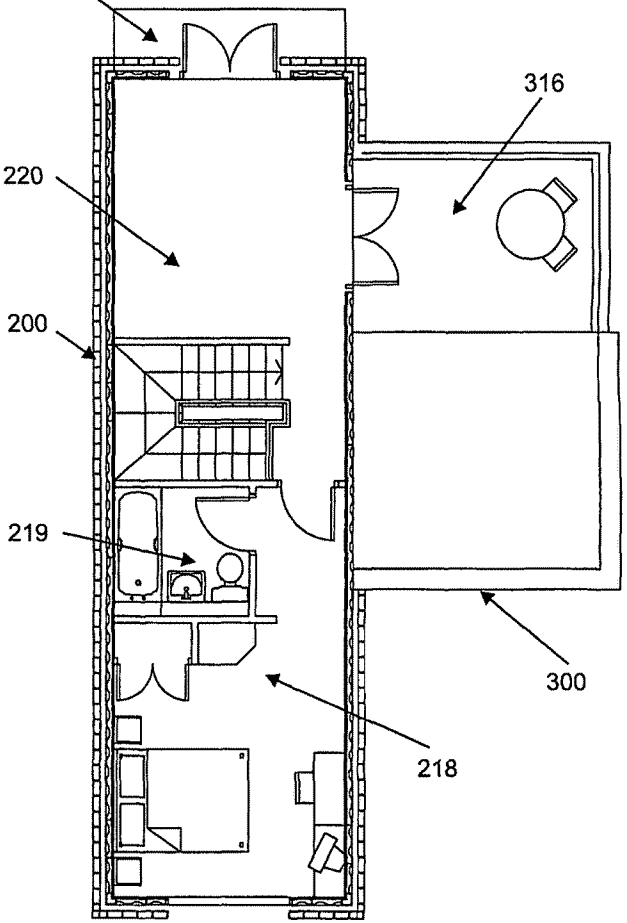
Figure 18A:
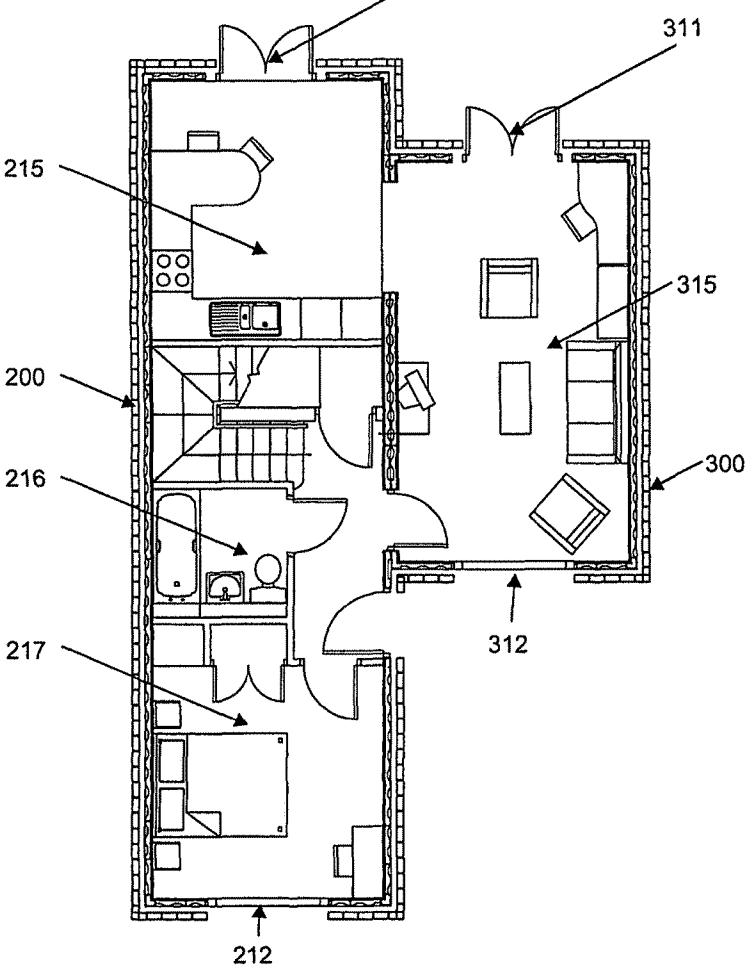
Figure 18D:
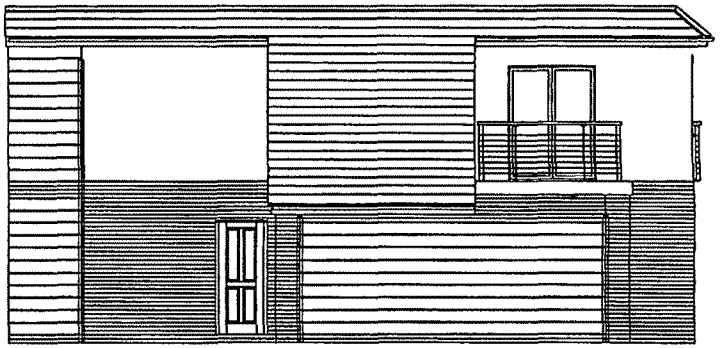
Figure 18C:
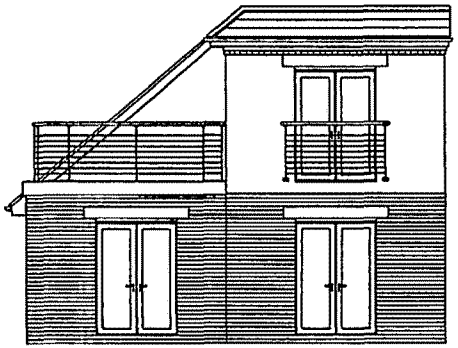

By way of example, certain embodiments of the invention will now be described with reference to the accompanying drawings, of which:

FIG. 1 is a perspective view of a building module,

FIG. 2 is a cut-away view of a part of the module of FIG. 1 showing the wall construction, FIG. 3 is a cut-away view of a part of the module of FIG. 1 showing the floor construction, FIG. 4 is a perspective view of a fourth building module being secured to three others during the construction of a building, FIG. 5 is a sectional plan view of one storey of a building formed from eleven modules in each storey, FIG. 6A is a perspective view of a first particular exemplary form of module, FIG. 6B is a perspective view of a second particular exemplary form of module, FIG. 6C is a perspective view of a third particular exemplary form of module, FIG. 6D is a perspective view of a fourth particular exemplary form of module, FIG. 7 is a perspective view of an open span construction formed from two modules, FIG. 8A is a fully exploded perspective view of a fastener assembly for fastening four containers together at adjacent corners, FIG. 8B is a partly exploded perspective view of the fastener assembly of FIG. 8A, FIG. 8C is a perspective view of the fastener assembly of FIG. 8A, FIG. 9A is an end view of the fastener assembly of FIGS. 8A to 8C with fastener bolts omitted, FIG. 9B is a side sectional view of the fastener assembly of FIG. 9A with fastener bolts omitted, FIG. 9C is a plan view of a connector element for use in the fastener assembly of FIG. 9A, FIG. 9D is an end view of a lock down plate for use in the fastener assembly of FIG. 9A, FIG. 9E is a side view of the lock down plate shown in FIG. 9D, FIG. 9F is a side sectional view of the complete fastener assembly of FIG. 9A, FIG. 9G is a fully exploded perspective view of the complete fastener assembly of FIG. 9A, FIG. 9H is a perspective view of the connector element shown in FIG. 9C, FIG. 9J is a perspective view of a first modified form of the connector element of FIG. 9H, FIG. 9K is a perspective view of a second modified form of the connector element of FIG. 9H, FIG. 10 is a perspective view of a module including brickwork on an end face of the module, FIG. 11 is a perspective view of a module with its top not shown and showing certain fittings in the module, FIG. 12A is a perspective view of a module with various dimensions marked, FIG. 12B is a perspective view of a modified form of the module of FIG. 12A with other dimensions marked, FIG. 12C is a perspective view of the module of FIG. 12B, showing how it may be engaged for handling and lock down, FIG. 13 is a perspective view showing a module being lowered onto a foundation interface ring, FIG. 14 is a perspective view of a module with a much shorter module fastened thereto in end-to-end relationship, FIG. 15 is a sectional view through a roof, floor and side of a pair of modules stacked on top of one another, FIG. 16A is a sectional view of an external wall of a module, FIG. 16B is a sectional view of adjoining internal walls of adjacent modules, FIG. 17A is a perspective view of a large module, FIG. 17B is a perspective view of a building formed from two of the modules of FIG. 17A together with a smaller module, FIG. 18A is a plan view of a fitted out ground floor of the building of FIG. 17B, FIG. 18B is a plan view of a fitted out first floor of the building of FIG. 17B, FIG. 18C is a first elevation of a fitted out building of the kind shown in FIGS. 18A and 18B, and FIG. 18D is a second elevation of the fitted out building of the kind shown in FIGS. 18A and 18B.

FIG. 1 shows a typical module in accordance with the invention. The module 10 is in the shape of a cuboid having opposite end faces 11 (only one of which is visible in FIG. 1), opposite side faces 12 (only one of which is visible in FIG. 1), a top face 13 and a bottom face 14. In the case of the example shown in FIG. 1, the module has an opening 15 in its side face extending from a region at the bottom of the face to a region at the top of the face, and an opening 16 in its end face extending upwardly from a region partway up the face. Panels 15A and 16A are provided to close the openings 15 and 16 respectively prior to final installation of the module. The opening 15 is of sufficient height to allow a person to walk through unobstructed and the opening 16 is of a suitable size and position to provide a window. Similar openings are provided in the other side and end faces not visible in FIG. 1.

The module 10 has a steel monocoque shell structure formed by four horizontal side rails 17, four horizontal end rails 18 and four vertical posts 19, all of open section, and by corrugated steel panels 20 welded between the rails.

At each corner of the module 10, a fastening element in the form of a respective corner casting 21 is provided. Each corner casting 21 is of the kind conventionally found on freight containers and is of hollow construction with external top, side and end apertures 22 providing access into the interior of the casting. Each casting 21 is made generally in accordance with ISO/TC-104-1161 but with variations in the external length of the casting in some cases and with the front apertures of the upper castings being in accordance with the dimensions set by the standard for the front apertures of the bottom castings.

FIG. 2 shows one particular internal wall construction that may be employed in the module of FIG. 1. In the example shown steel studding 23 of "L" shaped section is stitch welded to the interior of a steel panel 20, boards of insulation 24 are laid between the studding 23 and plywood 25 is then fixed to the studding 23 over the insulation 24.

FIG. 3 shows one particular floor construction that may be employed in the module of FIG. 1. Steel floor joists of inverted "L" shaped section 30 (or alternatively of "C" section) are fixed over the corrugated steel panel 20, boards of insulation 31 are laid between the joists 30, and plywood 32 is then fixed to the joists 30 over the insulation 31.

FIG. 4 shows schematically the assembly of four modules. A lower storey of modules 10A and 10B, each similar to the module 10 of FIG. 1, have been placed in position together with a module 10C which is directly above the module 10A. FIG. 4 shows a fourth module 10D being lowered into position on top of the module 10B to form a building comprising four modules. The manner in which the modules are fastened together is described below.

FIG. 5 shows one possible layout for a storey of modules, in this case providing bedroom accommodation that might typically be used for hotel, key workers or students. The storey shown comprises a single row of modules comprising two sets of four modules 50 with another module 51 interposed between each set and with further modules 52A and 52B at respective ends of the row of modules. The modules 50 within a given set are placed directly alongside one another without any stagger whilst the module 51, which is the same size and shape as the modules 50, is offset from the adjacent sets of modules 50. The further modules 52A and 52B are of a different shape from the modules 50 and 51 being shorter and wider.

Each of the modules 50 may be of the general structure shown in FIG. 1 with the openings 16 in the end faces of the modules providing exterior window openings and the openings 15 in the side faces of the modules allowing the creation of a central corridor 53 through the modules. As shown in FIG. 5, the modules 50 are internally divided by partitions 54 having doors 55 to define the walls of the corridor 53 and bedrooms 56 on each side of the corridor, two bedrooms being thereby created within each module 50.

In the example shown, the module 51 with openings in its side faces aligned with the corridor 53 contains at one end of the module a staircase 57 allowing access to a lower and/or upper storey through an opening in the roof and/or floor of the module 51. At the opposite end of the module 51 there is a space which may be used for services and/or a lift. In the particular example shown the further modules 52A and 52B are kitchens and each have three windows 58. The storey is shown without any external access but of course it should be understood that if external access is required, that can readily be provided, for example by providing an opening in an end face of the module 51 and forming a doorway in the opening.

Each of the bedrooms created in the modules 50 is shown fitted with a bathroom pod 59. Such pods which may for example include a toilet, washbasin and shower are known per se as prefabricated units and will not be described further here.

FIGS. 6A to 6D show possible variations of the basic configuration of a module. In FIG. 6A a module 60 with open end faces, a full height opening 61 in one side and a window opening 62 in the opposite side is shown. In FIG. 6B a module 63 with an open side face, an opposite closed side face and two end faces with window openings 64 is shown. In FIG. 6C a module 65 with an open side face, an open end face and with window openings 66 formed in the other side and end faces is shown. Finally, in FIG. 6D a module 67 with all its end and side faces open is shown. Whilst certain particular configurations have been shown by way of example, it will be understood that many other configurations are possible.

The modules shown in FIGS. 6A to 6D are approximately 1.5 times wider than the module 10 shown in FIG. 1. As will be described below, the corner castings 21 of a standard freight container are spaced apart by a standard width (2259 mm centre-to-centre spacing) to allow the container to be handled easily by conventional load handling apparatus and engaged by fastening devices on trailers. With a wider module, that spacing for conventional load handling apparatus can no longer be achieved by the corner castings 21 provided at the corners of the modules and an additional casting 68 is therefore provided along each top and bottom end rail 18 at the standard spacing from one of the corner castings 21. That enables the module to be readily handled by load handling apparatus engaging the additional casting 68 and the appropriate corner casting 21 on the same end rail 18. A pair of extra castings 69 are also provided on the bottom end rails 18 and on the top end rails 18, symmetrically positioned on opposite sides of a central vertical longitudinal plane through the module, at the standard separation (2259 mm centre-to-centre spacing). Those extra castings 69 allow a module to be fastened to standard fasteners on a road trailer with the module symmetrically placed on the road trailer and to be lifted symmetrically by standard lifting equipment.

It will be understood that the castings 68 and 69, not being at corners of the module have fewer apertures and indeed the castings 69 may have apertures only in their end faces or bottom/top faces if that is all that is required to secure them to a road trailer and lifting equipment.

In addition to employing modules in accordance with the invention as described above it is possible to use extra modules of special design to suit particular circumstances. For example it may be desirable to create a high open space within a building or on a side of a building and in that case an arrangement of the kind exemplified in FIG. 7 may be employed. The structure shown in FIG. 7 is an open span structure formed from a lower module 71 having a bottom face 72 and end faces 73 but no side faces and no top face, and an upper module 74 having a top face 75 and end faces 76 but no side faces and no bottom face. The modules 71 and 74 may be constructed as rigid structures or they may be formed from separately detachable panels allowing a flat pack style of transport. It may be noted that each module is provided with corner castings 21 at its eight corners.

An important feature of the described embodiments of the present invention is the fastening system that enables modules to be fastened together on site quickly, economically and securely. One exemplary form of that fastening system is shown in FIGS. 8A to 8C and 9A to 9G and will now be described with reference to those drawings in which FIGS. 8A to 8C provide an overview of the system and FIGS. 9A to 9G provide details of the various parts of the system.

Referring first to FIG. 8A, which is an exploded view, there are shown a corner casting 21A of a lower module, a corner casting 21B of an adjacent lower module, a corner casting 21C of an upper module stacked directly on top of the module with the casting 21A and a corner casting 21D of an upper module stacked directly on top of the module with the casting 21B. As will be understood, only the corner castings of the modules and not the remaining parts of the modules are shown in the interests of clarity.

A connector element 81 comprises in a single casting a central plate part 82, lugs 83A and 83B projecting downwardly from the plate part 82 and lugs 83C and 83D projecting upwardly from the plate part 82. The lugs 83A and 83B pass through apertures 84 in a lower gasket 85 and into the apertures 22 in the tops of the castings 21A and 21B. Similarly the lugs 83C and 83D pass through apertures 86 in an upper gasket 87 (identical to the lower gasket 85) and into the apertures 22 in the bottoms of the castings 21C and 21D.

Once the connector element 81 is installed as described, the corner castings 21A to 21D are positioned as shown in FIG. 8B. Lock down plates 88A and 88B, each carrying a pair of lugs 89A and 89B are then able to be inserted into the end apertures 22 of the corner castings. FIG. 8B shows the plates 88A and 88B about to enter the apertures.

The plates 88A and 88B have holes 90 which pass through the plates and the lugs 89A and 89B and align with threaded holes 91 in the lugs 83A to 83D of the connector element 81 when the corner castings 21A to 21C are properly assembled together. Then, as a final stage of fastening, bolts 92A to 92D with washers 93A to 93D are passed through the holes 90 and into screw threaded engagement in the holes 91 of the lugs 83A to 83D. The parts are then in the position shown in FIG. 8C.

FIGS. 9A to 9G illustrate the assembly just described in more detail. It uses a connector element of the kind shown in FIG. 9C having a central plate part 82 and four lugs 83A, 83B, 83C and 83D (of which only 83C and 83D are visible in FIG. 9C). That connector element is shown in perspective view in FIG. 9H.

It will be noted that the fastening system just described is suitable for joining four modules at respective adjacent corners. It will be appreciated that in other parts of the building, for example at a corner, there will be only one upper and one lower corner casting so that a connector element with only one lug on each side will be required. FIG. 9J shows such a connector element having a central plate part 82 and lugs 83A and 83C. Similarly, it will be appreciated that in some parts of a building having a three-dimensional array of modules it will be desirable to provide a connector element with four lugs on each side. FIG. 9K shows such a connector element having a central plate part 82 and lugs 83A to 83H.

It should be understood that whilst one particular locking system has been shown and described with reference to FIGS. 8A and 8B and 9A to 9G, other locking arrangements may be provided, for example to suit the accessibility of the connecting element. The lugs of the connector elements also ensure accurate alignment of modules as the modules are positioned on a partly constructed building.

FIGS. 10 and 11 show certain additional features which may be incorporated in a module according to the invention. For example, if it is desired to provide a brick covering over a face of the module, slots 101 may be provided in the steel panel 20 forming the end face, "T" shaped brick ties 102 may be slotted into the slots 101 and a brick shelf 103 may be fixed at the bottom of the end face. As shown in FIG. 10 the brickwork may be formed around a window 104. FIG. 11 also shows how pods, for example a bathroom pod or a kitchen pod, can be inserted through a side opening in the module to allow installation of such a module on site or prior to delivery to site.

FIG. 12A shows one example of a module, which may for example be the module 52A shown in FIG. 5. Most of the features of the module have been described above and are referenced by the same reference numerals in FIG. 12A. A further feature shown clearly in FIG. 12A is the provision along all the horizontal rails of fixing points 120 to which cladding systems, roof support systems or the like may be fixed. In one particular example the module 52A would have the following dimensions:

| | |
|---|---|
| overall exterior width, w: | 3660 mm |
| overall exterior length, l: | 6096 mm |
| overall exterior height, h: | 2900 mm |
| spacing between fixing points 120, s: | 900 mm |
| centre-to-centre distance of additional casting 68 from further corner casting on same end rail, d: | 2259 mm |
| centre-to-centre separation of extra castings 69, x: | 2259 mm |

It will be understood from the description above that the castings may be arranged in various ways according to the size of the module and the handling and connecting facilities that are required. FIG. 12B shows one especially advantageous arrangement of castings at an end of a module. In the arrangement shown there are four corner castings 21, a further four castings 69A, 69B, 69C and 69D along the top of the end of the module and a still further four castings 69A', 69B', 69C' and 69D' along the bottom of the end of the module. The other end of the module has the same arrangement of castings.

The castings are arranged symmetrically about the central vertical plane of the module indicated by the centre line C/L in FIG. 12B. Each of the castings 21, 69 is arranged at the standard spacing from another casting, that is at a distance marked D in FIG. 12B of 2438 mm measured from the outer edges of the castings (resulting in a centre-to-centre spacing of the apertures in the castings of about 2260 mm).

Usually, if the module is to be lifted by standard equipment for handling freight containers, then as shown in FIG. 12C and illustrated by solid line arrows, a spreader 95 will be lowered to engage the castings 69A and 69D at each end of the module. The weight of the module can then be evenly distributed on the spreader. Similarly, when locking down the module on, for example, a trailer chassis the module can be symmetrically positioned by using the castings 69A' and 69D' as implied by the dotted line arrows 96 in FIG. 12C. It should be noted, however, that another possibility is to position the module asymmetrically by using either of the castings 69B' or 69C', together with one of the corner castings 21; the dotted line arrows 97 in FIG. 12C illustrate this arrangement which may be useful when the module is stored on a container ship or is used in a building where it is desired to offset the modules in one storey from those in an adjacent storey.

It will be appreciated that although in FIG. 12B additional castings are shown only at the ends of the modules, they may also be provided partway along the lengths of the top and bottom side edges of the modules. Furthermore they may be provided away from the edges of any of the faces of the module if desired, for example for fixing other structural elements to the building. Thus, the castings may be in the region of the ends rather than at the ends of the module.

FIG. 13 shows a module such as the module 10 of FIG. 1 being placed on a foundation interface ring 130. The ring 130 is placed on an appropriate foundation and locked to it in an appropriate manner known per se. On the upper face of the ring 130 there are upwardly projecting connectors 131 of similar form to the connector elements 81 but with lugs 132 projecting on one side only from a plate 133 welded to the ring 130. In the example shown the connectors 131 each have a single lug 132 but it will be understood from the description above with reference to FIGS. 8A to 8C and 9A to 9G that they may also have a pair of lugs. The lugs 132 have screw threaded holes (not visible in FIG. 13) for receiving bolts that secure modified versions of the lock down plates 88A and 88B described above (the plates being modified such that each carries a single lug only with the bolt passing through the lug and into the screw threaded hole in the connector 131). It will be noted that the ring 130 is dimensioned to match the length of a module so that opposite ends of the module can be fastened to opposite sides of the ring. Special manual or automatic twist lock or other mechanically locked down connectors that can directly connect the modules to the foundations may be provided.

FIG. 14 shows a module 140 of similar dimensions to the module 10 described above together with another module 141 of the same height and width, but a much shorter length connected at the end of the module 10. The combination of the two modules preferably has a standard length, for example 40 ft (12192 mm). Such an end-to-end connection may provide a useful way of transporting the two modules together even if the short module is subsequently used in a different location in the building.

FIG. 15 shows a section through the floor, ceiling and external walls of two modules 151 and 152 stacked on top of one another. In the example shown windows 153 and 154 are provided in the modules 151 and 152 and brickwork 155 is provided on the exterior wall between the windows. The lower module 152 is shown with a pressed steel corrugated roof pan 156 below which are insulating panels 157A, a plywood lining 158A and a plasterboard finish 159A. The insulation panels 157A are held in place by "L" shaped sections 160A welded to the roof pan 156. In a similar way the floor of the upper module 151 comprises a pressed steel corrugated bottom face 161 on which insulating panels 157B are laid and secured in place by "L" shaped sections 160B welded to the steel corrugated face 161. A plywood floor 158B is laid over the panels 157B.

FIG. 16A shows a section (in plan view) through one example of an external wall structure. A corrugated steel skin 163 provides the structural strength and on the inside carries insulating panels 157C held in place by "L" shaped sections 160C. A plywood lining 158C is secured over the panels 157C and a plasterboard finish 159C is added. On the outside the steel skin 163 has a layer of insulation 164 and outside that brickwork 165 held to the skin 163 by ties which engage in slots 166 formed in plates 167 welded to the steel skin 163.

FIG. 16B shows a section (in plan view) through one example of adjoining internal walls 168A, 168B of adjacent modules. Each wall is of the same construction including a corrugated steel skin 163 which is exposed on its outer face confronting the adjacent module and on its inner face carries insulating panels 157D held in place by "L" shaped sections 160D welded to the skin 163. A plywood lining 158D is secured over the panels 157D and a plasterboard finish 159D is added.

Whilst certain particular embodiments of the invention have been described, it should be understood that these are of course only examples of many different possible arrangements. In the illustrated examples an upper storey of modules is placed directly above a lower storey and the modules in the upper storey are the same size as the modules in the lower storey. It should be understood, however, that this need not be the case. For example, the modules in the upper storey may be bigger or smaller than the modules directly below and/or the modules in one storey may be offset from the modules in another storey. In cases of this kind it is of course desirable for modules to have fastening elements partway along their edges so that the modules in one storey can be connected securely to the modules in another storey.

In the particular example of buildings illustrated, bedroom accommodation is provided. It will be understood that the modules may be employed in a variety of applications including housing, hotels, hostels, hospitals, care homes, and educational, social and leisure facilities, and in commercial, penal or industrial premises. Other applications include basements and cellars, car parking and storage. The accommodation provided by a module can take many forms including bedrooms, living rooms, dining rooms, kitchens, bathrooms, corridors, service voids, storage, bicycle sheds, stairwells, lift shafts, launderettes, community spaces and offices.

The buildings that are formed from the modules can be permanent building structures with a life expectancy as great or greater than those of a conventional building, and they can also easily be extended, converted or modified. Furthermore, if desired, a building can readily be dismantled and the modules moved elsewhere.

It will be understood that appropriate services can also be provided in the modules. Services may be run under floors, above ceilings through specially formed ducts etc. The modules may be provided with openings in appropriate locations to allow services to pass from one module to another.

FIG. 17A shows a large module 200 with various auxiliary parts displaced, as shown by dotted lines, to enable the construction to be better understood. The module 200 includes panels 201 in its top and 201' in its bottom, which are removed on site to provide a vertical passageway for a service duct. It also includes bracing/sealing panels 202, 203 and 204 which add strength to the module while it is being transported and lifted but can be removed on site to provide openings, and it further includes brick shelves 205 fixed along the bottom of the side to support brick cladding.

FIG. 17B shows two of the modules 200 of FIG. 17A mounted one on top of another, together with a further, smaller module 300. The smaller module 300 has a side opening that corresponds to a side opening in the module 200, has a brick shelf 305 and a bracing panel 302. The modules are shown connected to foundations 99.

FIG. 18A shows how the ground floor of the building shown in FIG. 17B may be fitted out. The building includes door openings 211 and 311 to the outside at one end of the building and window openings 212 and 312 at the other end. As shown there is provided on the ground floor a living room 315, a kitchen 215, a bathroom 216 and a first bedroom 217. On the first floor there is a second bedroom 218 and a bathroom 219 together with a third bedroom 220 which has a door onto a roof terrace 316 formed by part of the top of the module 300. At one end of the first floor a balcony 221 is connected to the upper module 200 and at the other end there is a large window. FIGS. 18C and 18D show external elevations that can be obtained in the case of a building of this type.

The invention claimed is:

1. A building module having an exterior shape generally of a cuboid having side, end, top and bottom faces, the module being hollow and defining a space adapted for human occupation, the module including fastening elements to allow the module to be fastened to another adjacent module and to allow for engagement by load handling equipment for handling freight containers, wherein the module has an overall exterior width greater than 2700 mm and includes:

a first set of two first fastening elements at opposite side edges of a top edge of a first end face of the module to allow the module to be fastened to another adjacent module; and a second set of two second fastening elements across the top edge of the module at locations in the region of the first end face of the module, the two second fastening elements being symmetrically positioned on opposite sides of a central lengthwise vertical plane of the module between the first end face and a second end face, wherein the second set of two second fastening elements are defined by hollow blocks with openings through which connector elements can be inserted for engagement by the load handling equipment for handling freight containers, wherein the first set of two first fastening elements and the second set of two second fastening elements are unconnected;

the second fastening elements being inboard of the side edges of the first end face at a centre-to-centre spacing of about 2260 mm to allow for engagement by load handling equipment for handling freight containers.

2. A building module according to claim 1, in which there are respective elongate members in the region of eight edges of the cuboid and a plurality of metal panels secured to at least some of the elongate members.

3. A building module according to claim 2, in which there are metal panels secured on all of the side and end faces of the cuboid.

4. A building module according to claim 3 in which at least some of the metal panels are corrugated.

5. A building module according to claim 3, in which at least some of the panels are of composite construction and include insulating material.

6. A building module according to claim 1, in which there are metal panels secured on the top and bottom faces of the cuboid.

7. A building module according to claim 1, in which at least one side face of the module is partly closed by a panel and is partly open.

8. A building module according to claim 7 in which the partly open face or one of the partly open faces extends from a region at the bottom of the face to a region at the top of the face.

9. A building module according to claim 7, in which the partly open face or one of the partly open faces extends upwardly from a region partway up the face.

10. A building module according to claim 1, in which at least one end face of the module is partly closed by a panel and is partly open.

11. A building module according to claim 1, including a kitchen pod containing kitchen fittings and occupying a part only of the interior volume of the module.

12. A building module according to claim 1, including a bathroom pod containing bathroom fittings and occupying a part only of the interior volume of the module.

13. A building module according to claim 1, in which the module includes fastening elements for fastening the module to an adjacent module placed alongside.

14. A building module according to claim 1, in which the module includes fastening elements for fastening the module to an adjacent module placed in end-to-end relationship.

15. A building module according to claim 1, in which the module includes fastening elements for fastening the module to an adjacent module placed immediately above or below.

16. A building module according to claim 1, in which at least some of the first set of fastening elements are defined by hollow blocks with openings through which connector elements can be inserted.

17. A building module according to claim 16, in which at least some of the first and the second set of fastening elements are provided with openings in top, side and end faces, or bottom, side and end faces of the fastening elements.

18. A building module according to claim 16, in which each of the at least some of the first and the second set of fastening elements include a connector element that has a first part for insertion into an opening in the fastening element of the module and a second part for insertion into an opening in another fastening element of another module.

19. A building module according to claim 16, in which each of the at least some of the first and the second set of fastening elements include a connector element that has a first, second, third and fourth parts for insertion into openings in respective fastening elements of first, second, third and fourth modules.

20. A building module according to claim 16, in which each of the at least some of the first and the second set of fastening elements include a connector element that has eight parts, each for insertion into a respective opening in a fastening element of a respective one of eight modules.

21. A building module according to claim 1, comprising a third set of two third fastening elements provided along the top edge of the first end face of the module.

22. A building module according to claim 21, wherein one of the two third fastening elements is about 2260 mm from one of the first fastening elements and a remaining third fastening element is about 2260 mm from a remaining first fastening element.

23. A building module according to claim 1, in which the overall exterior width of the module is in the range of 2700 mm to 5000 mm.

24. A building module according to claim 1, in which the overall length of the module is in the range of 6000 mm to 6100 mm.

25. A building module according to claim 1, in which the overall length of the module is in the range of 12100 mm to 12300 mm.

26. A building module according to claim 1, in which the overall length of the module is in the range of 13600 mm to 13800 mm.

27. A building module according to claim 1, in which the exterior of the module is fitted with a plurality of additional fastening elements for interfacing with an external wall cladding system or a roofing system.

28. A building module having an exterior shape generally of a cuboid having side, end, top and bottom faces, the module being hollow and defining a space adapted for human occupation, the module including fastening elements to allow the module to be fastened to another adjacent module and to allow for engagement by load handling equipment for handling freight containers, wherein the module has an overall exterior width greater than 2700 mm and includes:

a first set of two first fastening elements at opposite side edges of a top edge of a first end face of the module to allow the module to be fastened to another adjacent module, wherein at least some of the first set of fastening elements are defined by hollow blocks; and a second set of two second fastening elements across the top edge of the module at locations in the region of the first end face of the module, the two second fastening elements being symmetrically positioned on opposite sides of a central lengthwise vertical plane of the module between the first end face and a second end face, wherein the second set of two second fastening elements are defined by hollow blocks with openings through which connector elements can be inserted for engagement by the load handling equipment for handling freight containers, wherein the first set of two first fastening elements and the second set of two second fastening elements are unconnected; and connector elements, wherein each connector element comprises a first part and a second part of the same shape, each of the first and second parts including a gasket, and wherein the first part and the second part are each shaped to fit within an opening in one of the hollow blocks of the first set of fastening elements.

29. A building module according to claim 28, in which the connector elements and hollow blocks are arranged such that after a connector element has been inserted into an opening in a hollow block the connector element can be fastened in the opening by a fastener entering the hollow block through another opening and engaging the connector element.

30. A building module according to claim 28 in which the connector elements are fastened in the hollow blocks by fasteners threadedly engaging the connector elements in the hollow blocks.

31. A building module according to claim 28, further comprising connector bolts, wherein the first part and the second part of each of the connector elements includes a threaded hole; and wherein each connector bolt is configured to pass through an opening in one of the hollow blocks of the first set of fastening elements and threadingly engage with the threaded hole in the first part or the second part.

32. A building module according to claim 31, further comprising at least one connector plate, wherein each connector plate includes a base and two protrusions;

wherein each of the protrusions is shaped to fit within an opening in one of the hollow blocks of the first set of fastening elements; and wherein each plate includes two through holes, each of the through holes located through the base and a respective protrusion.

33. A building module according to claim 32, wherein each connector bolt is configured to pass through one of the through holes before threadingly engaging with the threaded hole in the first part or the second part, and wherein threaded engagement of the connector bolts with the connector elements fixes the connector elements and the connector plates to the building module.

34. A multiplicity of modules fastened together to form part or all of a building, each of the modules being according to claim 1.

35. A multiplicity of modules according to claim 34, in which at least one of the modules has a length which is less than one fifth of the length of another of the modules that is the longest module.

36. A multiplicity of modules according to claim 34, further including a foundation interface having a lower face for resting on foundations and an upper face carrying connector elements for engagement with a plurality of fastening elements located on each of the multiplicity of modules and operable to fasten each of the multiplicity of modules to the foundation interface.

37. A multiplicity of modules according to claim 36, in which the foundation interface is in the form of one or more rectangular rings.

38. A multiplicity of modules according to claim 34, further including an inter-story interface for placing between stories of modules, the inter-story interface having a lower face carrying first connector elements for engagement with a first plurality of fastening elements on modules in a story immediately below the interface and having an upper face carrying second connector elements for engagement with a second plurality of fastening elements located on modules in a story immediately above the interface.

39. A multiplicity of modules according to claim 38, in which the inter-story interface is in the form of one or more rectangular rings.

40. A building comprising: a multiplicity of modules, the modules being fastened together to form all or part of the building, each respective one of the modules being according to claim 1, the modules with aligned openings in adjacent walls of adjacent modules to allow a person to move from one module to another.

41. A building according to claim 40, including a plurality of the modules fastened together in a side by side relationship.

42. A building according to claim 40, including a plurality of the modules fastened together in end-to-end relationship.

43. A building according to claim 40, in which there are a plurality of stories of the modules, the modules in one story being fastened to modules in an adjacent upper or lower story.

44. A method in constructing a building a site, the method compromising the following steps:

fabricating a plurality of modules according to claim 1 at a location remote from the site, transporting the fabricated modules to the site, and fastening together fastening elements of said modules to connect the modules together with aligned openings in adjacent walls of adjacent modules to allow a person to move from one module to another.

45. A method according to claim 44, in which the fabricated modules are engaged by their fastening elements to secure them during the transporting step.

46. A method according to claim 44, in which the modules are engaged by their fastening elements to move them into their final positions at the site.

47. A building module having an exterior shape generally of a cuboid having side, end, top and bottom faces, the module being hollow and defining a space adapted for human occupation, the module including fastening elements to allow the module to be fastened to another adjacent module and to allow for engagement by load handling equipment for handling freight containers, wherein the module has an overall exterior width greater than 2700 mm and includes:

a first set of two first fastening elements at opposite side edges of a top edge of a first end face of the module to allow the module to be fastened to another adjacent module;

two further fastening elements spaced across the top edge of the module at a centre-to-centre spacing of about 2260 mm, at least one of the two further fastening elements being inboard of the side edges of the module, to allow for engagement by load handling equipment for handling freight containers, wherein one of the further fastening elements is partway along the length of the top side edge of the module in the region of the first end of the module, wherein the two further fastening elements are defined by hollow blocks with openings through which connector elements can be inserted for engagement by the load handling equipment for handling freight containers, wherein the first set of two first fastening elements and the two further fastening elements are unconnected; and a second set of fastening elements including fastening elements at the opposite side edges of a second, opposite, end of the top of the module to allow the module to be fastened to another adjacent module and two further fastening elements spaced across the top of the module at a centre-to-centre spacing of about 2260 mm, at least one of the two further fastening elements being inboard of the side edges of the module, to allow for engagement by standard load handling equipment for handling freight containers, wherein one of the further fastening elements is partway along the length of the top side edge of the module in the region of the second end of the module.

48. A building module having an exterior shape generally of a cuboid having side, end, top and bottom faces, and fabricated from metal, the module being hollow and defining a space adapted for human occupation, the module including fastening elements to allow the module to be fastened to another adjacent module and to allow for engagement by load handling equipment for handling freight containers, wherein the module has an overall exterior width greater than 2700 mm and includes:

a first set of two first fastening elements including two fastening elements spaced across the top edge of a first end face of the module at locations in the region of the first end of the module, the two fastening elements being symmetrically positioned on opposite sides of a central lengthwise vertical plane from the first end face to a second end face of the module and inboard of the side edges of the module at a centre-to-centre spacing of about 2260 mm, at least one of the two fastening elements being inboard of the side edges of the module, to allow for engagement by the load handling equipment for handling freight containers;

two further fastening elements spaced across the top of the module at a centre-to-centre spacing of about 2260 mm to allow for engagement by the load handling equipment for handling freight containers, wherein the two further fastening elements are defined by hollow blocks with openings through which connector elements can be inserted for engagement by the load handling equipment for handling freight containers, wherein one of the further fastening elements is partway along the length of the top side edge of the module in the region of the first end of the module, wherein the first set of two first fastening elements and the two further fastening elements are unconnected; and a second set of fastening elements including two fastening elements spaced across the top of the module at locations in the region of the first end of the module, the two fastening elements being symmetrically positioned on opposite sides of a central lengthwise vertical plane of the module and inboard of the side edges of the module at a centre-to-centre spacing of about 2260 mm, at least one of the two further fastening elements being inboard of the side edges of the module, to allow for engagement by the load handling equipment for handling freight containers and two further fastening elements spaced across the top of the module at a centre-to-centre spacing of about 2260 mm to allow for engagement by the load handling equipment for handling freight containers, wherein one of the further fastening elements is partway along the length of the top side edge of the module in the region of the second end of the module.

* * * * *